US007250119B2

(12) United States Patent
Sayala

(10) Patent No.: US 7,250,119 B2
(45) Date of Patent: Jul. 31, 2007

(54) COMPOSITE MATERIALS AND TECHNIQUES FOR NEUTRON AND GAMMA RADIATION SHIELDING

(76) Inventor: Dasharatham Sayala, Science & Technology Applications, LLC, 1887 Cold Creek Ct., Vienna, VA (US) 22182

( * ) Notice: Subject to any disclaimer, the term of this patent is extended or adjusted under 35 U.S.C. 154(b) by 0 days.

(21) Appl. No.: 11/121,852

(22) Filed: May 4, 2005

(65) Prior Publication Data

US 2005/0258405 A1 Nov. 24, 2005

Related U.S. Application Data

(60) Provisional application No. 60/569,798, filed on May 10, 2004.

(51) Int. Cl.

| | |
|---|---|
| ***G21F 1/04*** | (2006.01) |
| ***G21F 1/02*** | (2006.01) |
| ***G21F 1/06*** | (2006.01) |
| ***G21F 1/08*** | (2006.01) |
| ***G21F 1/10*** | (2006.01) |

(52) U.S. Cl. ..... 252/478; 588/3; 588/4; 588/5; 588/6; 588/7; 588/11; 588/12; 588/15; 588/16; 250/506.1; 250/515.1; 250/518.1

(58) Field of Classification Search ..... 252/478, 252/62; 588/3, 4, 5, 6, 7, 11, 12, 15, 16; 506/506.1, 515.1, 518.1
See application file for complete search history.

(56) References Cited

U.S. PATENT DOCUMENTS

| | | | | |
|---|---|---|---|---|
| 2,726,339 | A * | 12/1955 | Borst | 250/518.1 |
| 3,173,884 | A * | 3/1965 | Jackson | 252/478 |
| 3,238,148 | A * | 3/1966 | Osborne | 252/478 |
| 3,645,916 | A * | 2/1972 | Hall et al. | 252/478 |
| 4,188,231 | A * | 2/1980 | Valore | 106/700 |
| 4,210,619 | A * | 7/1980 | Haley | 264/140 |
| 4,687,614 | A * | 8/1987 | Suzuki et al. | 264/40.1 |
| 4,727,257 | A * | 2/1988 | Grifoni | 250/518.1 |
| 5,334,847 | A * | 8/1994 | Kronberg | 250/506.1 |
| 5,457,262 | A * | 10/1995 | Huang et al. | 588/3 |
| 5,601,643 | A * | 2/1997 | Silverstrim et al. | 106/624 |
| 5,786,611 | A * | 7/1998 | Quapp et al. | 250/515.1 |
| 6,120,706 | A * | 9/2000 | Lessing et al. | 252/478 |
| 6,166,390 | A * | 12/2000 | Quapp et al. | 250/506.1 |
| 2002/0165082 | A1 * | 11/2002 | Singh et al. | 501/155 |

* cited by examiner

*Primary Examiner*—Joseph D. Anthony

(57) ABSTRACT

This invention deals with multi-component composite materials and techniques for improved shielding of neutron and gamma radiation emitting from transuranic, high-level and low-level radioactive wastes. Selective naturally occurring mineral materials are utilized to formulate, in various proportions, multi-component composite materials. Such materials are enriched with atoms that provide a substantial cumulative absorptive capacity to absorb or shield neutron and gamma radiation of variable fluxes and energies. The use of naturally occurring minerals in synergistic combination with formulated modified cement grout matrix, polymer modified asphaltene and maltene grout matrix, and polymer modified polyurethane foam grout matrix provide the radiation shielding product. These grout matrices are used as carriers for the radiation shielding composite materials and offer desired engineering and thermal attributes for various radiation management applications.

8 Claims, 5 Drawing Sheets

COMPOSITE MATERIALS AND TECHNIQUES FOR NEUTRON AND GAMMA RADIATION SHIELDING

CROSS-REFERENCE TO RELATED PATENT APPLICATION

This application claims priority of U.S. Provisional Application Ser. No. 60/569,798, filed on May 10, 2004, the disclosure of which is herein incorporated by reference.

BACKGROUND OF THE INVENTION

1. Field of the Invention

This invention deals with materials and techniques for shielding of neutron and gamma radiation emitting together from radioactive waste sources such as transuranic and high-level wastes. It is based on specially formulated composite materials and techniques. In particular, this invention relates to different composite materials and admixtures, and their multifaceted application to safe handling, containerization and management of neutron and gamma emitting high-level, transuranic and low-level radioactive wastes and materials, as well as to decontamination and decommissioning of radioactively contaminated facilities. Owing to their significant capacity for attenuation of neutron and gamma radiation, these technologies relates to protecting health and environment from exposure to harmful radiation emitted by nuclear wastes and materials.

2. Description of the Related Art

Radioactive wastes, owing to temporal decay and fission of radionuclides, emit alpha, beta, gamma and neutron radiation, of which neutron and gamma radiation are extremely harmful. Radioactive wastes can be solids, liquids and sludge, and these are of three types:

A) High-level radioactive wastes contain gamma emitting long-half life radionuclides, such as plutonium (Pu-238, Pu-239, Pu-240 and Pu-242) and uranium (U-234, U-235, and U-236). High-level wastes include spent (or used up) nuclear fuel and wastes from commercial and defense related nuclear reactors resulting from reprocessing of spent nuclear fuel. Most spent nuclear fuel in the United States is currently located in pools of water, at nuclear generating plants across the country, to protect workers from radiation. Spent fuel also is stored in large concrete casks. High-level wastes are also generated from reprocessing of fuel from weapons production reactors to obtain materials to make nuclear weapons. These wastes are primarily in liquid and sludge forms.

B) Transuranic (TRU) wastes contain such radionuclides as californium Cf-249-252), americium (Am-241, 242 and 243), curium (Cm-242-250), neptunium (Np-235 and 236), plutonium (Pu-236-242) and berkelium (Bk-247 and 250). Generally, TRU wastes are made up of solids or liquids and contain radionuclides that have more than 20-year half-lives. TRU wastes are generated by defense nuclear research and development activities, such as development and fabrication of nuclear weapons. TRU wastes are usually classified as "contact-handled" (CH) and "remote-handled" (RH) wastes. These are highly radioactive with high radiation flux of neutrons and gamma rays, as well as alpha rays. Often, these wastes are mixed with hazardous organic and inorganic wastes, and therefore, they are also called as transuranic mixed wastes.

C) Low-Level radioactive wastes do not include either high-level or transuranic waste materials. Most low-level wastes (classified by the NRC as A, B or C) emit relatively low-levels of radiation from radioactive decay of short half-life radionuclides, such as strontium-90, cesium-137, krypton-85, barium-133 and beryllium-7 and 10. Generally, these wastes have radioactivity that decays to background levels in less than 500 years and about 95 percent of the waste decays to background levels in about 100 years. Low-level radioactive wastes are generated by commercial and university laboratories, pharmaceutical industries and hospitals, as well as nuclear power plants. Low-level wastes include both solid and liquid wastes.

High-level wastes are very radioactive, which emit extremely harmful gamma (like x-rays) and neutron radiation. RH-TRU wastes are primarily neutron and secondary gamma radiation emitters, CH-TRU wastes are also very radioactive, which emit harmful alpha radiation, as well as neutron radiation. In order to handle these wastes, heavy concrete and/or lead shielding materials are required and high energy flux energy radioactive wastes, such as RH-TRU wastes, are robotically handled despite the concrete/lead shielding. One of the main radiation hazards posed by this waste is through exposure and inhalation or ingestion. During handling and management, inhalation of or exposure to certain transuranic wastes, such as plutonium in very small quantities, could deliver significant internal radiation doses.

Exposure to gamma and neutron radiation, as well as alpha and beta radiation, associated with these wastes can induce chronic, carcinogenic and mutagenic health effects that lead to cancer, birth defects and death. However, thousands of tons of both solid and liquid, as well as sludge radioactive wastes have been generated in the past and they will continue to be generated in the future by commercial/private industries and government agencies. Unless they are safely and cost-effectively shielded, managed and disposed, these wastes may pose serious health and economic consequences.

Generally, alpha radiation can be easily shielded by paper, skin or clothes, where as beta radiation can easily pass through paper, skin or clothes but it will be blocked by a thin layer of plastic, aluminum foil or wood. In contrast, gamma and neutron radiation is very penetrating, and neutron radiation is more penetrating than gamma. Gamma radiation can be blocked by heavy shielding materials such as thick-concrete, lead, steel and Ducrete (depleted uranium mixed with concrete); whereas neutron radiation can penetrate through heavy metal shielding, only specially engineered and chemically formulated high density concrete blocks and lead can shield penetration of neutron radiation from its source.

High-level radioactive wastes are currently stored at nuclear power plants and DOE facilities across the country. Similar wastes have been generated by the Department of Defense also. Department of Energy's Office of Civilian Radioactive Waste Management (OCRWM) is charged with identifying and developing a suitable site for deep geologic disposal of these wastes. The OCRWM is currently conducting research and testing to determine the suitability of the Yucca Mountain, Nev. site for long-term safe disposal of these wastes. Transuranic wastes are destined to be disposed into an already established geologic repository at WIPP site in Carlsbad, N. Mex. Class A and B low-level radioactive wastes are currently disposed in isolated shallow burial ground; whereas greater than class C waste low-level waste use deep geologic disposal in specially licensed facilities.

Management and disposal of high-level, transuranic and low-level radioactive wastes are very risky. Radioactive waste management also includes decontamination and decommissioning of contaminated sites. Management activities, prior to disposal, include handling, solidification of liquid wastes, loading, storage, radiation monitoring, reloading of wastes into transportable containers, and transport of waste containers to long-time safe disposal sites. Storage, transportation and disposal of radioactive wastes are a growing problem in the United States and abroad. Many U.S. commercial power plants do not have sufficient existing capacity to accommodate future spent nuclear fuel wastes, and much of the DOE's HLW and TRU wastes are currently located in unlicensed storage structures that need to be upgraded or replaced. Therefore, there is a strong need for improved radiation shielding materials and techniques for waste container systems so that the wastes can be safely stored, transported and disposed.

Currently, two main methods are used for storage of commercial power plant nuclear waste: wet and dry. In wet storage, the waste is immersed in a lined, water-filled pool, which shields the radiation and removes radioactive heat aided by an active system. Wet storage is intended for a period of five years after waste immersion, and thereafter, it is stored in dry storage casks or vaults constructed out of concrete, which shield the radiation. Generally, the design and manufacturing of waste containment systems for the dry storage are governed by a number of governing factors, such as 1) shielding effectiveness, 2) structural integrity and durability, 3) thermal performance, 4) ease of handling and transportation, 5) high volume waste loading, 6) cost-effectiveness, and 7) health and environmental protection.

Current radiation shielding and waste containment technologies are based on low or high density concrete, lead, carbon and stainless steel, borated resins, polymers and other additives, as well as glass vitrification and ceramic calcinations. However, these materials and processes have limitations and they do not fully satisfy the above-mentioned governing factors of waste containment systems. Some examples of these limitations are as follows:

The above mentioned shielding materials or additives and technologies do not meet the shielding requirements of radiation waste sources consisting of a flux of mixed radiation types of various energy levels and the secondary radiation effects (e.g., emission of secondary gamma radiation due to inelastic collision or capture of emitted neutrons) that are induced within the shields as a result of interaction of the initial flux with certain atoms in the shield itself.

While thin liners of lead, used in waste storage casks and containers, are effective for shielding gamma radiation, they are not very effective in shielding neutron radiation. When applied as a part of a neutron particle shielding, lead has an extremely low level of neutron absorption, and hence, practically no absorption of secondary gamma radiation. For neutron shielding, thicker lead liners are required, which not only reduces the space for waste loading in the containment systems but also makes the containment systems heavy for handling and transport. Consequently, lead technology can be costly. If the shield material has a high rate of neutron capture, it will over time become radioactive, and sharply reduce its effectiveness as a shield material, consequently, their subsequent handling and disposal will be a problem. In addition, lead can be leached and will contaminate the environment, potentially posing toxic health effects.

Although some containment systems have used concrete liners, castings or grouts as safe storage of radioactive wastes, they are not very effective in shielding high energy flux of neutron and gamma radiation, unless significantly thick high density concrete liners in conjunction with metal liners are used. Generally, concrete liners are not very efficient in shielding neutron radiation because, concrete products have low hydrogen atomic density, which is the measure of a materials ability to shield neutron radiation. In addition, concrete-based containment systems generally lack mobility, and therefore, limit the volume of radioactive wastes that can be stored in a given limited space due to the high density and volume concrete required to obtain the necessary shielding properties. As a result, the application of this technology to waste containment systems can be uneconomical. In addition, chemical and mechanical properties of concrete can be degraded due to alkali-silica-reaction (at <5 pH) and at elevated radioactive temperatures, resulting in shrinkage and cracking and consequential attenuation of its shielding capacity. Similarly, the bonded water in cement grouts tends to decrease with time due to radioactive heat, causing increase in porosity and reduction in shielding capacity. Traditionally, Portland cement-based grouts have been used for solidification/encapsulation of hazardous and low level radioactive wastes. However, this technology has shown to be effective only in situations where the salt loading is relatively low (i.e. <10%) and when the total organic content of the waste is below 3%. Given the above limitations, use of concrete based technology for solidification of liquid wastes and storage of high-level and transuranic wastes may be inappropriate.

Borated stainless steel has been used in the radioactive waste storage containers; however, this material, owing to its weak mechanical/metallurgical properties, has the potential for cracking and breaking, rendering weak shielding capacity over a long period of time. Further, the bombardment of borated stainless steel by the neutrons emitted by the wastes can reduce the steel's shielding efficacy, making it an unsuitable material for long term safe storage of high-level and transuranic wastes.

In the case of vitrification technology, there is significant uncertainty in effectiveness of in-situ or ex situ vitrification technology for solidification of liquid wastes with variable compositions and pH conditions, as well as for volatile components. In addition, glass production and chemical durability of vitrified glass is unknown. In glass production, the largest uncertainties are related to the reliability and safety of the high-temperature melting process behavior of the glass during the first and second glass pours, such as the effects of glass fracturing on chemical and physical durability, and the significance of mixed waste-constituents crystallization. Owing to rapid cooling rate and high viscosity of oxide and silicate, waste constituents/molecules cannot move sufficiently to be uniformly incorporated into crystalline structure of the glass. Furthermore, vitrification may produce secondary wastes and management of such wastes would be an issue to contend with. In terms of chemical durability of glass, very little is known about the type and conditions of formation of colloids and less about their ability to bind up and transport the waste constituents. Corrosion of vitrification melt materials from acidic wastes is a key issue that must be dealt with.

In an attempt to reducing the thickness of concrete shield while maintaining the desired long-life of the waste containers, Suzuki et al (U.S. Pat. No. 4,687,614) taught a three layered structure comprising a metallic vessel with a reinforced concrete lining as an inner layer, and polymerized and cured impregnated layer as intermediate layer between the inner concrete layer and the outer metallic layer. However, this and similar other attempts have been unsuccessful in achieving the desired reduction in thickness. In addition, this three layered system was found to be not very effective in shielding high energy flux of neutron and gamma radiation.

Kronberg (U.S. Pat. No. 5,334,847) teaches an alternate shielding system using depleted uranium core for absorbing gamma rays with a bismuth coating for preventing corrosion, and alternatively having a gadolinium sheet positioned between the depleted uranium core and the bismuth coating for absorbing neutrons. However, this shielding system does not reduce the undesirable density and thickness of the shielding to maintain the desired capacity for shielding of high flux neutron and gamma radiation. In addition, this shielding system is neither efficient in avoiding the depleted uranium corrosion nor assuring the durability of the shielding system over desired long-life, particularly at elevated temperatures. Owing to the uranium corrosion, this system is considered inefficient for shielding of neutron and gamma radiation fluxes. In addition, corrosion can cause leaching and release of uranium from the concrete in the form of uranium bicarbonate and uranium tri-carbonate complexes, causing health and environmental problems. Furthermore, this system is relatively expensive.

Yoshihisa, in Japanese Patent Document No. 61-091598, teaches utilization of depleted uranium and uranium oxide aggregate containing concrete for radiation shielding. While this system has the potential for reducing the thickness of radiation shielding for gamma rays, it has serious problems of concrete degradation and maintaining the desired long-life of the system, particularly at elevated radioactive temperatures. Tensile and compressive strengths of concrete are seriously compromised by addition of the uranium aggregate to the concrete. Quapp et al. (U.S. Pat. Nos. 5,786,611 and 6,166,390) disclose radiation shielding of containers for storing spent nuclear fuel waste. These containers are formed from concrete product with stable uranium oxide aggregate and a neutron absorbing material. The neutron absorbing materials described are $B_2O_3$, $HfO_2$ and $Gd_2O_3$. In addition, the concrete shielding composition of this invention requires including reinforcing materials. These may include, steel bars, fillers and strengthening impregnates, such as steel fiber, glass fiber, polymer fiber, lath or steel mesh, creating a complex system of shielding.

However, owing to the uranium corrosion problem, this concrete shielding products along with their additives are not efficient for radiation shielding and they do not contribute to the long-time durability of waste containers, especially at elevated temperature. Corrosion can cause leaching and release of uranium from the concrete in the form of uranium bicarbonate and uranium tricarbonate complexes, causing health and environmental problems. Further, this type of shielding containers does not reduce the undesirable density and thickness of the shielding to maintain the desired capacity for shielding of high flux neutron and gamma radiation. In addition, cooling of concrete surfaces is required during radioactive waste storage to further the length of the concrete to avoid high radioactive temperature, without which, the concrete system could degrade and allow for emission of radiation. Generally, concrete systems lack mobility and limit the volume of radioactive wastes to be stored in a given space due to great concrete thickness and density required to obtain the necessary shielding properties.

The above mentioned shielding materials and systems, using single component or dual component materials provide only limited shielding capacity under a given set of density, thickness and configuration of shielding materials and containers. Generally, they do not offer the desired shielding of both neutron and gamma emitted from the same waste source, particularly the transuranic waste source or its containers. These materials and techniques suffer from the problems of offering desired shielding efficiency, long-term durability, health and environmentally safety. In addition, the systems are complex and made up of multilayered dense and thick layers of concrete admixed with depleted uranium, lead and stainless steel, which reduce the volume of containers/casks for radioactive waste loading. Consequently, more containers/casks have to be built to store or transport a given volume of radioactive wastes; therefore, those containment systems are not cost-effective. Furthermore, high density containment systems are not be easily mobile and are very difficult to handle, in addition to being unsafe.

In general, the prior art uses many kinds of additives to meet the shielding requirements of a particular radiation spectrum and energy flux involved, but they are not effective in meeting the desired shielding requirements of radiation fluxes of different energy levels arising from complex, uncharacterized radioactive waste sources. This situation may be further complicated when secondary radiation effects are induced as a result of interaction of initial radiation flux with certain atoms in the waste materials, as well as within a given shielding material. Therefore, it is necessary to formulate admixture composite materials that offer optimal total radiation shielding capacity to cater to the needs of such complexities.

Accordingly, it is desirable and advantageous to provide improved materials and simple techniques that offer a better, more durable and cost-effective radiation shielding and waste containment systems than those mentioned above. Improved materials and techniques shall enhance the safety of handling, storage, transportation, long-time containment of radioactive wastes, as well as protect human health and environment. In addition, it is desirable for such materials and techniques to have such attributes as a) applicable to shield multi spectral and energy flux radiation, b) ease of application, c) easy to handle variations in waste characteristics without the need for separation of incompatible wastes that do not generate secondary waste streams, d) will not expose workers to any significant and unnecessary amount of radiation and e) exhibit superior performance over regulatory long times.

BRIEF SUMMARY OF THE INVENTION

This invention pertains to multi-component composite materials and techniques that provide improved capabilities for shielding highly penetrating, harmful neutron and gamma radiation, as well as alpha and beta radiation emitted by high-level, transuranic and low level radioactive wastes. These radiation shielding composite materials offer better and more cost-effective shielding capabilities than those of the conventional concrete, lead and steel shields. This invention is drawn to a combination of elements that uses selected naturally occurring minerals and materials which result in this combination of elements producing synergistic and unexpected shielding effects, which is exclusively a result of such use. The objectives of this invention are as follows:

a) It is the intent and premise of this invention to formulate and offer multi-component composite materials in different permutations and combinations, as well as in various proportions and grain size to provide a total cumulative capacity for shielding of neutron and associated gamma radiation of variable fluxes and energies, and which exceeds the capacity of conventionally used shielding materials or the materials known in the prior art.

b) To provide combinatorial radiation shielding compositions admixed with different carrier grout matrices, which will provide a significantly improved radiation attenuation. These radiation attenuation compositions are designed for use in various management aspects of radioactive solid, liquid and sludge wastes, as well as radioactive wastes mixed with hazardous organic and inorganic wastes. The multifaceted use includes such applications as inner and over packs and liners of radioactive waste containment systems, as corrosion-resistant coatings on the surfaces of casks and containers used for storage, transport and permanent disposal of radioactive wastes, as well as coatings on the drip shields in radioactive waste repositories, as prefabricated structures and liners for waste storage vaults and as decontamination of radioactively contaminated equipment/facilities.

c) To provide formulated materials and compositions in a predetermined proportion for use in waste containment systems that will allow for minimum thickness of liners or inner and over packs of the waste containment systems while achieving desired shielding of both neutron and gamma radiations, wherein the reduction in thickness of shielding liners or inner and over packs will allow for enhanced container volume for more waste loading.

d) To provide significant improvements over conventional or known art materials and techniques by offering effective radiation shielding, safe radioactive waste management, ease of implementation or application, cost-effectiveness, and durability.

e) To provide specially designed materials and compositions for water tight grouting and coating of underground storage metal tanks, containers and radioactive beryllium blocks for eliminating water infiltration and metal corrosion, diffusion of radioactive gases such as radon and iodine, and for resisting the damage from high energy flux of neutron and gamma radiation.

f) To provide improved materials and techniques that can be used for solidification, encapsulation and immobilization of radioactive liquid and sludge wastes.

g) To improve materials and techniques that can be cost-effectively applied to safe management of decontamination and decommissioning of radioactively contaminated facilities and equipment.

h) To formulate materials and techniques for safe and cost-effective management of uranium and thorium mine tailings and mill wastes.

DETAILED DESCRIPTION OF THE INVENTION

Figure 1:
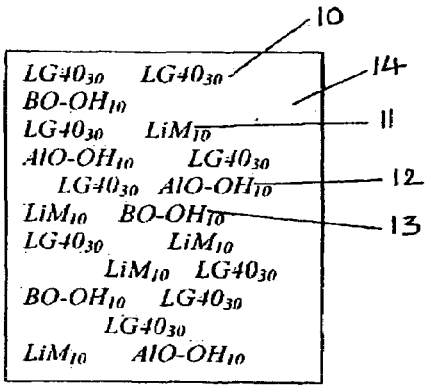
FIG. 1 is a cross sectional view of formulated Admixture Composite Material-A for neutron and gamma radiation shielding. Legend: 10 represents 30 weight percent leaded glass with 40% lead ($LG40_{30}$), 11 represents 10 weight percent lithium mineral material ($LiM_{10}$), 12 represents 10 weight percent aluminum oxides and hydroxides mineral material ($AlO—OH_{10}$), 13 represents 10 weight percent boron oxides and hydroxides mineral material ($BO—OH_{10}$) and 14 represents 40 weight percent Type-A carrier grout matrix
Figure 2:
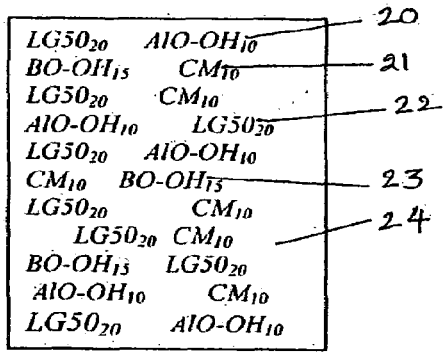
FIG. 2 is a cross sectional view of formulated Admixture Composite Material—B for neutron and gamma radiation shielding. Legend: 20 represents 10 weight percent aluminum oxides and hydroxides mineral material ($AlO—OH_{10}$), 21 represents 10 weight percent carbonaceous mineral material ($CM_{10}$), 22 represents 20 weight percent leaded glass with 50% lead ($LG50_{20}$), 23 represents 15 weight percent boron oxides and hydroxides mineral material ($BO—OH_{15}$) and 24 represents 45 weight percent Type-A carrier grout matrix.
Figure 3:
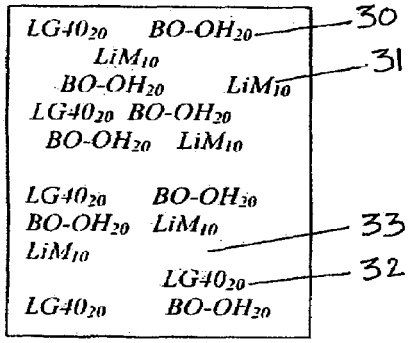
FIG. 3 is a cross sectional view of formulated Admixture Composite Material—C for neutron and gamma radiation shielding. Legend: 30 represents 20 weight percent boron oxides and hydroxides mineral material ($BO—OH_{20}$), 31 represents 10 weight percent lithium mineral material ($LiM_{10}$), 32 represents 20 weight percent leaded glass with 40% lead ($LG40_{20}$) and 33 represents 50 weight percent carrier grout matrix (30 weight percent Type-A and 20 weight percent Type-B carrier grout matrix).
Figure 4:
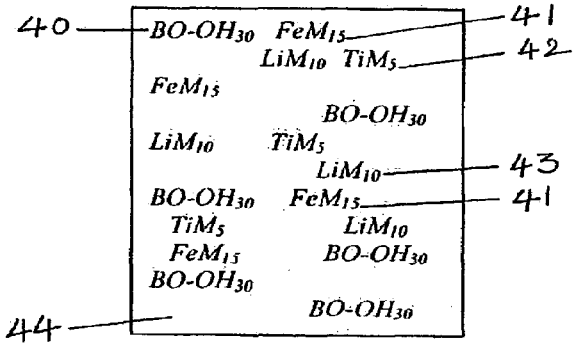
FIG. 4 is a cross sectional view of formulated Admixture Composite Material—D for neutron and gamma radiation shielding. Legend: 40 represents 30 weight percent boron oxides and hydroxides mineral material ($BO—OH_{30}$), 41 represents 15 weight percent iron-bearing materials ($FeM_{15}$), 42 represents 5 weight percent titanium mineral material ($TiM_5$), 43 represents 10 weight percent lithium mineral material ($LiM_{10}$) and 44 represents 40 weight percent Type-C carrier grout matrix.
Figure 5:
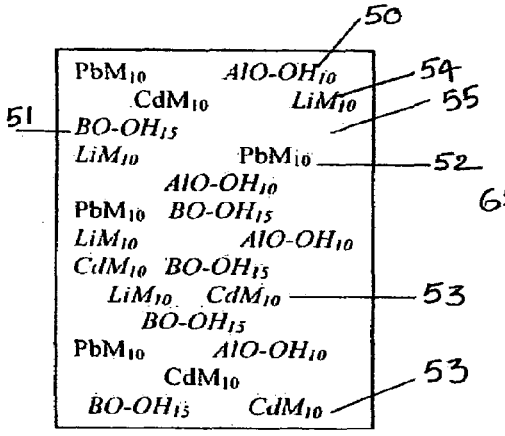
FIG. 5 is a cross sectional view of formulated Admixture Composite Material—E for neutron and gamma radiation shielding. Legend: 50 represents 10 weight percent aluminum oxides and hydroxides mineral material ($AlO—OH_{10}$), 51 represents 15 weight percent boron oxides and hydroxides mineral material ($BO—OH_{15}$), 52 represents 10 weight percent lead mineral material ($PbM_{10}$), 53 represents 10 weight percent cadmium mineral material ($CdM_{10}$), 54 represents 10 weight percent lithium mineral material ($LiM_{10}$) and 55 represents 45 weight percent Type-B carrier grout matrix.
Figure 6:
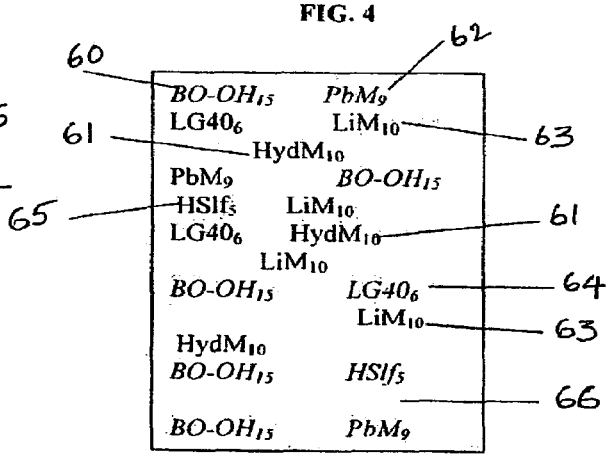
FIG. 6 is a cross sectional view of formulated Admixture Composite Material—F for neutron and gamma radiation shielding. Legend: 60 represents 15 weight percent boron oxides and hydroxides mineral material ($BO—OH_{15}$), 61 represents 10 weight percent hydride material ($HydM_{10}$), 62 represents 9 weight percent lead mineral material ($PbM_9$), 63 represents 10 weight percent lithium mineral material ($LiM_{10}$), 64 represents 6 weight percent leaded glass with 40% lead ($LG40_6$), 65 represents 5 weight percent hydrated sulfate mineral material ($HSlf_5$) and 66 represents 45 weight percent Type-C carrier grout matrix.

This invention deals with materials and techniques for improved shielding of neutron and gamma radiation emitting together from radioactive waste sources such as transuranic and high-level wastes. It is based on specially formulated multi-component composite materials and techniques. This invention is drawn to a combination of elements that uses selected naturally occurring minerals and materials which results in this combination of elements producing a synergistic and expected shielding effects, which is exclusively a result of such use. In particular, this invention relates to various composite materials and modified carrier grout admixtures and techniques for formulating and producing final Admixture Composite Materials, which will provide enhanced radiation shielding capacity and multifaceted application to safe handling, containerization and management of neutron, gamma, beta and alpha emitting high-level, transuranic and low-level radioactive wastes and materials, as well as to decontamination and decommissioning of radioactively contaminated facilities.

The shielding materials and techniques of this invention provide more desirable and advantageous attributes than those available in the prior art. These attributes include a) unparalleled radiation shielding capacity for both neutron and gamma radiation, b) shielding of multi-spectral and fluxes of different radiation energy levels, c) easy to handle variations in waste characteristics without a need for segregation of incompatible wastes or without generation of secondary wastes, d) enhance the safety of handling, storage, transportation and long-time containment of radioactive wastes, without workers' exposure to any unsafe amount of radiation, e) durability, f) ease of application and f) cost-effectiveness.

Description of this invention is provided below to enable those of ordinary skill in the art to practice this invention for using the formulated multi-component composite materials and techniques for shielding neutron and gamma radiation, as well as alpha and beta radiation emitted from complex radioactive waste sources. Since the relative penetration capacity of alpha and beta radiation is significantly lower than that of gamma and neutron, any composite materials formulated and engineered for shielding of neutron and gamma radiation will undoubtedly shield alpha and beta radiation fluxes.

Generally, the selection of shielding materials is depended upon many factors, such as desired shielding of radiation levels, ease of heat dissipation, resistance to chemical degradation and radiation damage, desired thickness, density and engineering properties, uniformity of shielding capability, ease of application, multifaceted application, cost-effectiveness and long time durability. Depending on the type of application, selected multi-component composites are formulated by using combinatorial percent proportions of mineralogical compounds and materials for providing effective shielding of the full spectrum and flux of neutron and gamma radiation, as well as alpha and beta radiation. Neutron attenuation is accomplished by the selected composite materials mainly through elastic and inelastic scatter by reducing the energy of the neutrons until they are absorbed (neutron capture) in the shielding materials. During the inelastic scattering, secondary gamma radiation is generated, which is also attenuated by certain components of the formulated composite materials. The embodiments of multi-component shielding materials, as well as the carrier grout matrices for attenuation or shielding of both neutron and gamma radiations are described below. The scope of this invention encompasses the full ambit of the claims and all available equivalents.

Figure 8:
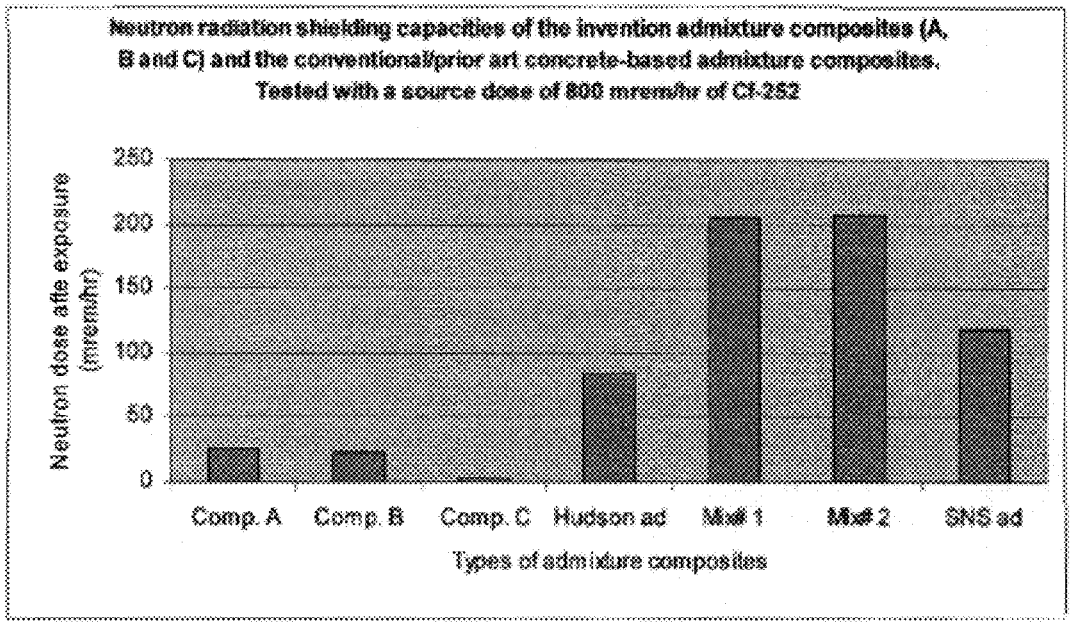
FIG. 8 is a plot of the neutron shielding capacities of the formulated Admixture Composite Materials A, B and C (Comp A, Comp B, and Comp C) of this invention compared with other prior art or conventionally used concrete-based admixtures. Comp A and Comp B are admixed with Type-A carrier grout matrix, and Comp C is admixed with Type-A and Type-B carrier grout matrices.
Figure 9:
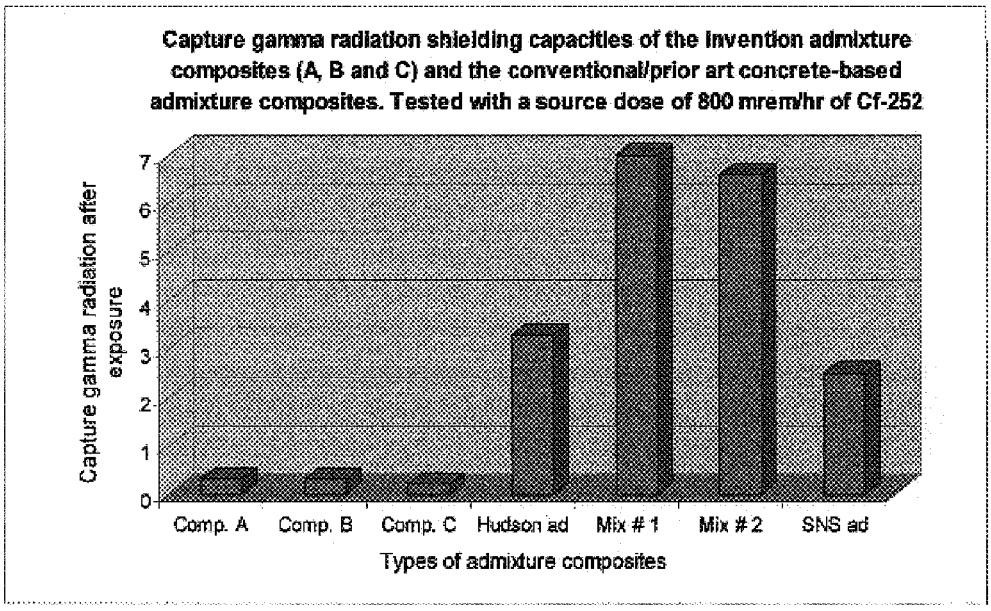
FIG. 9 is a plot of the capture gamma shielding capacities of the formulated Admixture Composite Materials A, B and C (Comp A, Comp B and Comp C) of this invention compared with other prior art or conventionally used concrete-based admixtures. Comp A and B are admixed with Type-A carrier grout matrix, and Comp C is admixed with Type-A and Type-B carrier grout matrices.

For combined shielding of neutron and gamma radiation of different energies and fluxes, desired naturally occurring minerals and materials are selected and proportionately combined to form a multi-component composite material that will synergistically provide a desired optimal radiation shielding capacity. The proportions may vary from 0-100 weight percent. These are made up of exclusive groups of naturally occurring raw minerals and materials. These groups include: lead mineral and material compounds, boron mineral and material compounds, aluminum mineral and material compounds, coaliferous mineral and material compounds, titanium mineral and material compounds, hydrides, sulfate mineral and material compounds, iron mineral and material compounds, lithium mineral and material compounds and cadmium mineral and material compounds, and combinations thereof. In addition, leaded glass and hydrides can also be used alternatively. The use of naturally occurring minerals in a synergistic combination with modified cement, modified asphaltenes/maltenes or modified polyurethane foam carrier grout matrices is hitherto unknown in the prior art, and as can be seen in FIG. 8 and FIG. 9, provides unexpected and unobvious radiation shielding results.

Leaded-glass materials useful for this invention include glasses with 20 percent, 30 percent, 40 percent and 50 percent lead. In addition and depending on percent lead contents, these leaded-glasses indigenously contain silicon dioxide (40 to 68%), sodium oxide (about 5%), barium oxide (about 2.4%), aluminum oxide (about 1.8%), calcium oxide (about 1.5%), strontium oxide (about 1.5%), potassium oxide (about 1.0%) and antimony oxide (about 0.3%). These materials may be recovered from glass waste streams, such as CRT (Cathode Ray Tube) scraps from computer monitors, television screens and the like. Such recycled materials to be used herein are processed to remove any leachable hazardous constituents, which may be present in or on the particles of the recycled glass materials, as described in U.S. Pat. Nos. 6,666,904 and 6,669,757 disclosures, of which are herein incorporated by reference.

Lead-bearing minerals and materials useful for this invention include naturally occurring lead-bearing hydrated minerals (cerussite and linarite), silicates (larsenite and other complex lead-silicates), sulfides (galena and other lead-sulfides), and sulfates (anglesite and other lead-sulfates), oxides (wulfenite and other lead-oxides), as well as other lead-bearing compounds, such as but not limited to lead-bearing refractory ceramics, lead-chromates, tetraethyl lead, lead acetate or combinations thereof.

The boron minerals and materials useful for this invention include naturally occurring oxy-hydroxide minerals, such as but not limited to tincal, datolite, hydroboracite, kernite, priceite, probertite, sassolite, szaibelyite, tincalconite and ulexite, in addition to other compounds, such as but not limited to borides such as aluminum dodecaboride, magnesium tetraboride, barium hexaboride, calcium hexaboride, iron boride, magnesium tetraboride, manganese tetraboride, and silicon hexa- and tetraborides and other boride compounds or combinations thereof.

The mineralogical materials of aluminum useful for this invention include naturally occurring hydrated and silicate minerals, such as but not limited to bauxite, cryolite, boehmite, gibbsite, diaspore, heulandite, clinoptilite, stilbite, barrerite as well as other aluminum bearing compounds or combinations thereof.

The coaliferous minerals considered useful for this invention include naturally occurring bituminous and anthracite coal materials (90-95% carbon) with variable amounts of associated minerals (5-10%) such as quartz (SiO2), mullite ($AlgSi_2O_{13}$), tricalcium aluminate ($Ca_3Al_2O_6$), melilite [($Ca_2$ $(Mg,Al)(AlSi)_2O_7$)], merwinite [($Ca_3Mg(SiO_4)_2$)], ferrite spine 1((Mg,Fe)(Fe.A1)$_2$)], pyrite ($FeS_2$), magnetite ($Fe_3O_4$), hematite ($Fe_2O_3$), lime (CaO), anhydrite ($CaSO_4$), periclase (MgO), and alkali sulfates ($(Na,K)_2SO_4$) or combinations thereof.

Titanium minerals and materials of this invention include naturally occurring oxide minerals, such as but not limited to ilmenite, rutile, brookite, anatase, titano-magnetite, as well as other titanium compounds or combinations thereof.

Hydride materials considered useful for this invention include materials such as but not limited to ditantalum hydride, lithium hydride, titanium dihydride, and other hydrides or combinations thereof.

In the case of sulfate-bearing minerals and materials, naturally occurring hydrated sulfate minerals, such as but not limited to gypsum, anhydrite, jarosite, barite, melanterite, as well as compounds such as but not limited to magnesium sulfate heptahydrate and lithium hydrazinium sulfate, sodium thiosulfate or combinations thereof are considered useful for this invention.

The iron-bearing minerals and materials useful for this invention include naturally occurring minerals, such as but not limited to oxides, hydrated oxides, carbonates and sulfates of iron (hematite, magnetite, siderite, goethite, limonite, ferberite, foresterite, melanterite, lepidocrocite and ferrihydrite), as well as other iron compounds or combinations thereof.

The minerals and materials of lithium useful for this invention include naturally occurring silicate, phosphate and sulfate minerals, such as but not limited to lepidolite, spodumene, petalite, amblygonite and others like, as well as other compounds, such as but not limited to lithium sulfate, hydrated lithium hydrazinium sulfate and lithium hydride and other lithium compounds or combinations thereof.

Among the cadmium minerals and materials useful for this invention are naturally occurring minerals, such as but not limited to cadmium sulfide (greenockite and cadmium ocher), cadmium selenite (cadmoselite), cadmium chloride, cadmium sulfate, cadmium fluroborate, cadmium carbonate and cadmium oxides, and other cadmium compounds, such as but not limited to cadmium nitrates, cadmium acetates and others like or combinations thereof.

For radiation shielding purposes, selective minerals and materials from the above-mentioned groups are selected in various proportions and combined to form multi-component composites. These are then grinded to desired grain size and mixed with different types of selected grout matrix, which act as a medium for carrying the composite material and provide desired structural engineering and thermal properties for application of radiation shielding composites to various radioactive waste containment systems, management of decontamination of radioactively contaminated facilities and equipment, as well as for other shielding needs. In addition, the components of carrier grout matrix will augment the radiation shielding capacity. Three types of primary carrier grout matrices/admixtures are considered useful for this invention. These are described as follows:

Type-A—modified cement carrier grout matrix: For this type of grout matrix, various types of Portland cements are considered. These include Type I or II Portland cements or their modified forms, with various additives, to meet the specific engineering requirements (e.g. compressive strength, tensile strength and shear-bond strength) of a given application. The modified cements include hydrated calcium-alumina silicate cements with iron (Ciment Fondu®), alumina-hydrated calcium sulfate cement, magnesium oxychloride-phosphate cements, plaster of Paris cements, silica-gel and clay cements. To these cements, additives such as but not limited to polyethylene fibers, steel fibers, polymeric graphite, ground blast furnace slag and cement-kiln dust are added to reinforce the cements for structural integrity and durability. Similarly, Class N pozzolan fly ash is added to eliminate any Alkali-Silica-Reaction (ASR) problem and enhance the mechanical integrity of cement carrier grout. Alternatively, the Type B or Type C carrier grout matrix, described below, can be also admixed with modified cement in different proportions to achieve desired mechanical and thermal properties of the carrier grout matrix. Overall, these modified cement carrier grout matrix is compatible for mixing with and hosting various combinations and proportions of the above mentioned minerals and materials to form Admixture Composite Materials to provide an augmented radiation shielding capacity with desirable engineering and thermal properties, durability and attributes for a specific application.

Type-B—polymer modified asphaltenes and maltenes carrier grout matrix: For this type of admixture, polymer modified asphaltenes and maltenes, with special additives, such as but not limited to emulsifiers, dispersants, gallants, stabilizers (antioxidants), aromatic solvents, plasticizers, fire retardants, and curing and cross-linking agents are used to meet the specific functional requirements (e.g. resistant to impact, shock, leaching and high temperatures; non-pyrophoric; low permeability and density; and desirable engineering strength and durability) of a specific application. Depending on the requirements of a specific application, these additives may also include materials such as but not limited to thermoplastic elastomers and polymers, thermosetting modifiers, chemical modifiers, fibers, adhesion improvers, natural asphalts or fillers or combinations thereof. Alternatively, the Type A or Type C carrier grout matrix (described below) can also be admixed with modified asphaltenes and maltenes in different proportions to achieve desired mechanical and thermal properties. Overall, these types of carrier grout matrices are compatible for mixing with and hosting various combinations of the above mentioned minerals and materials to provide an augmented radiation shielding capacity with desirable engineering and thermal properties, and durability, as well as attributes for a specific application.

Type-C—polymer modified polyurethane foam carrier grout matrix: For this type of grout matrix, different types of commercially available polyurethane raw materials, such as but not limited to aromatic isocynates [diphenylmethane 4, 4' diisocyanate (MDI)] and aromatic isocyanurate [toluene 2, 4 and 2, 6 diisocyanates (TDI)], aromatic isocynates and polyols are used. These are modified by additives such as but not limited to cross-linkers (triols and tetrols), catalysts (amines, metal salts and organometallic compounds), surfactants and blowing agents (silicones). A two component system is used to generate an appropriate carrier grout matrix for mixing with the composited minerals and materials, mentioned above. Alternatively, commercially available polymer/resin modified polyurethane foams such as but not limited to ethylene bis-tetrabromophthalimide, chlorinated phosphonate ester, neutral phosphorus-based polyol, hexabromocyclododecane, tetrabromocuclooctane, hexabromododecane, bisphenol-A type epoxy or others, including combinations thereof can be also used as carrier grout matrix. These modified polyurethane foams are relatively less dense (about 2.0 lbs/c.ft or 0.032 g/cm$^2$) resistant to high temperature, high impact and chemical leaching, non-pyrophoric or flame retardant, and exhibit desirable adhesive and coating properties, as well as desirable engineering properties. Alternatively, the Type A or Type B carrier grout matrix (described above) can be also admixed with modified polyurethane carrier grout matrix in different proportions to achieve desired mechanical and thermal properties, as well as attributes for a specific application. Overall, these modified foam matrices are compatible for mixing with and hosting various combinations of the above mentioned neutron-gamma shielding composite materials to provide an augmented radiation shielding capacity with engineering and thermal properties, and durability.

Figure 7:
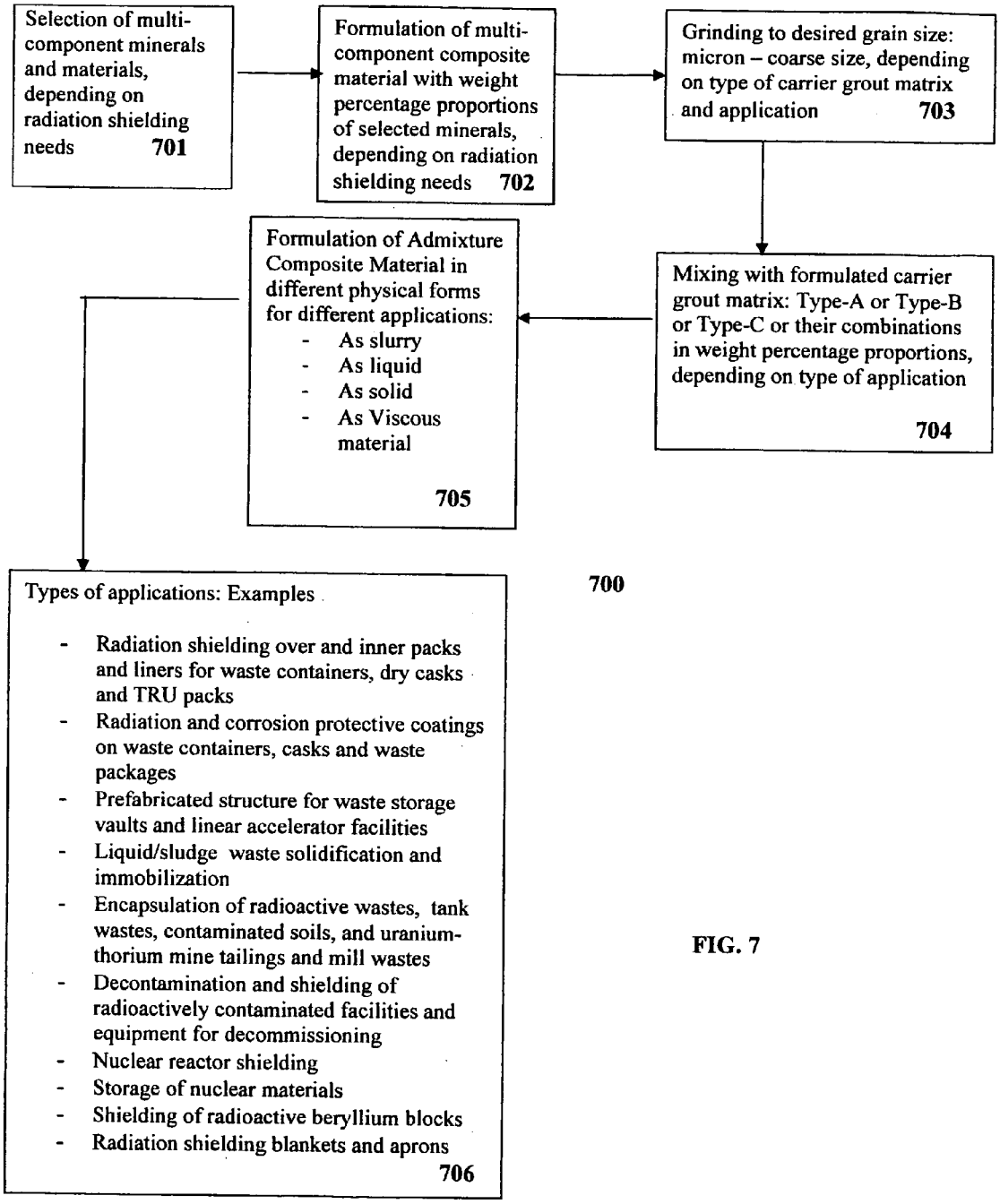
FIG. 7 is a flow chart diagram showing the selection of materials and techniques leading to the development of the final admixture composite materials for various applications.

Depending on the type of application, the formulated composite radiation shielding materials are ground to desired grain size (see 703 in FIG. 7) and mixed with a selected carrier grout matrix or their combinations thereof, in various weight percentages and grain-size (see 704 in FIG. 7), to form a "final admixture composite materials" for a specific application (see 705 in FIG. 7).

Effective radiation shielding results from the use of exclusive admixture composite materials of this invention, which are enriched with the atoms that provide a substantial cumulative absorptive cross-section, measured in barns (a measure of probability of absorption) and elastic scattering capacity for attenuation of neutrons and gamma rays. Generally, fast neutrons have a low probability of capture by the nuclei of shielding materials; however, they are attenuated through elastic scattering in the shielding materials containing such atoms as hydrogen and lithium. In contrast, slow or thermal neutrons have high probability of capture, via inelastic scattering, by the desired atoms or isotope of atomic nuclei of components in the shielding materials used, and the probability varies depending on the type and concentration of the radioactive isotopes and the desired atomic nuclei or atoms. Upon capture of neutrons, most nuclei emit gamma rays (capture gamma, also called secondary gamma) of an energy characteristic of that type of nuclei. Examples of the thermal neutron capture cross-sections of nuclei of shielding materials and the resulting capture-gamma energies are given in Table 1 below.

TABLE 1

Absorption cross sections of atoms and isotopes of shielding materials

| Nuclei of isotopes of shielding components | Absorption cross-section (barns) | Absorptive capture gamma energies (MeV) | Atoms of shielding components in natural abundance | Absorptive cross-section (barns) |
|---|---|---|---|---|
| $H^1$ | 0.33 | 2.23 | Hydrogen | 332 ± 2 |
| $Li^6$ | 950 | 0.0 | Lithium | 71 ± 1 |

TABLE 1-continued

Absorption cross sections of atoms and isotopes of shielding materials

| Nuclei of isotopes of shielding components | Absorption cross-section (barns) | Absorptive capture gamma energies (MeV) | Atoms of shielding components in natural abundance | Absorptive cross-section (barns) |
|---|---|---|---|---|
| $B^{10}$ | 3840 | 0.478 | Boron | 750 ± 10 |
| $C^{12}$ | 0.0034 | 4.95 | Carbon | 0.0032 ± 0.0002 |
| $Cd^{113}$ | 20,000 | 9.05 | Cadmium | 2500 ± 100 |

From the data in the above table, it is obvious that while cadmium concentrated shielding material has 5.2 times more capacity for capturing neutrons than boron concentrated material, they have the disadvantage of generating about 19 times more capture gamma than boron material. It is also obvious from the table that the advantage of using boron containing shielding material is that the probability of capturing neutrons is roughly 10,000 better than hydrogen containing material, and such material can also reduce the energy of capture gamma rays from 2.23 Mev to 0.478 Mev. However, hydrogen has the capacity to slow down the fast neutrons, through elastic scattering, which results in slow thermal neutrons. In contrast to cadmium and boron materials, lithium materials have the advantage of not generating any capture gamma radiation, although they have relatively low capacity for capturing neutrons. Therefore, it is advantage to combine lithium, hydrogen and boron bearing minerals and materials for use in radiation shielding.

The results of the above mentioned paragraphs are summarized as follows, which form a basis for formulating a multi-component composite materials using naturally occurring raw minerals: 1) When dealing with fluxes of mixed radiation types of various energy levels, it is essential to have multi-component materials, consisting of naturally occurring minerals, in different combinations and proportions to create a balanced and enhanced radiation shielding capacity, 2) In multi-component composite materials, while one component of a mineral significantly attenuates neutron radiation, by capture, and generates more capture gamma, the other mineral component(s) can significantly attenuate the gamma radiation in addition to neutron attenuation. Thus a balance is created for achieving a desired optimal radiation shielding, 3) Certain isotopes of atoms are effective in radiation shielding, but hydrogen, boron, lithium, cadmium and others in their natural state (viz. in natural occurring minerals and materials) have adequate quantities of the desired isotopes for providing required shielding capacity, and therefore, processing to enrich the amount of desired isotopes is neither necessary nor desired from an economic point of view, 4) The overall effectiveness of shielding materials in arresting thermal neutrons and gamma rays is based on the total cumulative shielding capacity of a multi-component system or composite, derived out of combining different types of naturally occurring minerals and materials, which exclusively offer higher total cumulative absorption cross-section, than a commercially created single component and 5) The multi-component composite minerals and materials of this invention can form one single layer/liner to provide a total cumulative capacity to adequately shield radiation of different fluxes and energy levels, thus, providing the safety of workers, and health and environment protection, as well as economic benefits.

Based on the above-mentioned, it is the intent and premise of this invention to formulate and offer various composite materials, made up of multi-component minerals and materials and admixed with carrier grout matrices in different combinations, proportions and grain sizes to form final Admixture Composite Materials. These materials will significantly enhance the capacity for shielding various fluxes of mixed radiation types and energy levels, emanating from complex, interactive radioactive waste sources.

Depending on the needs of a radiation flux and energy level, the minerals from the aforementioned groups of minerals and materials are preferentially selected and combined in various combinations and permutations, in weight percentages to formulate the multi-component composite materials. In the formulation of the composite materials, the weight percentage of a group of minerals and materials can vary from 0.0 percent to 100.0 percent. For example, in one radiation shielding case, if lead, boron and lithium containing groups of minerals and materials are considered, then in the first step, a number of preferred minerals and materials from those groups are selected. In the second step, 40 weight percent of the boron group of minerals/materials, 30 weight percent of the lithium group of minerals/compounds and 30 weight percent of the lead group are considered for formulating a required batch of composite materials. The selection and proportions of preferred minerals and compounds from those groups may be different in a second radiation shielding case, and the preferred weight percentages may be 30, 50 and 20 weight percentages for boron group, lithium group and lead group of minerals respectively. Such proportional combinations, designed to provide a synergistic material composites for effective radiation shielding of combined neutron and gamma radiation are hitherto not known in the prior art, and as can be seen in FIG. 8 and FIG. 9, provides unexpected and unobvious results.

Grain size is one of the variables that affect the physical make up and engineering properties of the final admixture composite materials. Generally, voids and in-homogeneities in the admixture composite materials are created if proper grain size of formulated composite materials is not achieved for homogenously mixing with carrier grout matrices. Voids and in-homogeneities can compromise the integrity, desired engineering and thermal properties and durability of final admixture composite materials for use in radiation shielding. These problems can be easily avoided by selecting proper grain size of the composite materials based on the type of carrier grout matrix and nature of application. For example, in constructing liners or prefabricated structures for radioactive waste storage casks or vaults, Type-A carrier grout based admixture composite materials are required. For preparing formable mortar mixture and slurry, using modified cement carrier grout, it is necessary to select fine to coarse grain size composite materials to fill the voids. These grain sizes will promote tightly and homogenously packed density and structural integrity. In addition, the grain size has to be compatible with all phases or components of carrier grout matrices so that proper bonding can be created for setting the mortar mix. In contrast, for applying the shielding products by spraying to coat waste containers, radioactively contaminated equipment and facilities for decontamination and decommission, micron to fine grain size particles of composite materials are preferred with Type-B or Type-C carrier grout matrix. Generally, particle size and size distribution, in addition to material density, are closely related to shielding thickness. Selection of particle size of the formulated multi-component composites appropriate for a specific carrier grout matrix will significantly increase the homogeneity of the final admixture composite materials, and reduce the porosity of the shielding media and provide effective shielding of radiation emitted by all kinds of radioactive materials and wastes. Furthermore, such reduction in porosity of admixture composites, especially the Type-B carrier grout based composite materials, will significantly reduce the diffusion of radioactive gases such as radon and iodine. Therefore, it is necessary to maintain the desired grain size of the formulated composite materials when formulating various admixture composite materials for radiation shielding. The stepwise method for selection of shielding material (701), and techniques for formulating composite materials (702) and carrier grout matrices (704), as well as the processes leading to the development of the final Admixture Composite Material (705) for various types of applications (706) are shown in FIG. 7.

In formulating the composite materials of this invention, naturally occurring raw mineral materials are preferred over manufactured materials. One of the main advantages of using only naturally occurring raw mineral materials is that they contain major and minor elements/atoms that are vital for enhancing shielding of both neutron and gamma radiations for safe radioactive waste containment. In addition, the multi-component atoms of these naturally occurring mineral materials, when combined will have a synergistic effect to augment the radiation shielding capacity. For example, boron mineral—Priceite ($CaB_{10}O_{19}7H_2O$) provides 10 atoms of boron and 14 atoms of hydrogen, which will have more neutron attenuation capacity (about 12048 barns of absorption cross section) than a commercially produced Boron oxide ($B_2O_3$) with only two boron atoms, not hydrogen. Similarly, when Priceite ($CaB_{10}O_{19}7H_2O$) is combined with mineral Lepidolite mica [$(K_2Li_3Al_4Si_7(OH, F)_3)$], the combined composition provides 10 atoms of boron, 17 atoms of hydrogen, 3 atoms of lithium and 4 atoms of aluminum for shielding. Thus, this combination cumulatively provides much more neutron attenuation capacity (about 13258 barns of absorption cross-section) than a single mineral component or a commercially produced compound. Since neutron inelastic scattering interaction with lithium does not produce capture gamma, its presence in mineral composite material will undoubtedly help to reduce overall gamma radiation. Similarly, presence of calcium minerals, such as Priceite ($CaB_{10}O_{19}7H_2O$) and Gypsum ($CaSO_4.0.5H_2O$) in composite mineral material will also reduce gamma radiation by absorption. Aluminum and silica in Lepidolite mica are refractory components that have the capacity to contain the radioactive temperatures in the shield. The other advantage is that the cost of these naturally occurring mineral materials is generally lower than that of the industrially produced shielding materials or components. Therefore, naturally occurring multi-component minerals and materials are preferred over commercially produced single component compounds In formulating and preparing the final admixture composite materials for radiation shielding, naturally occurring raw mineral materials that offer optimal radiation absorption and radioactive heat containment are selected (see 701 in FIG. 7), along with an application based modified carrier grout matrix (see 704 in FIG. 7). The selected raw mineral materials are formulated into multi-component composite material by using their different combinations and weight percent proportions (see 702 in FIG. 7), and are subjected to grinding for achieving desired particle size(s) (see 703 in FIG. 7), which will be compatible for mixing with a selected carrier grout matrix. This ground material is then admixed with a preferred carrier grout matrix (see 704 in FIG. 7) to produce the final Admixture Composite Material (see 705 in FIG. 7). In formulating and preparing the final admixture composite materials for radiation shielding, the weight percentages of composite materials and the modified carrier grout matrices can vary from 5-75 and 25-95, respectively to make up 100 weight percent of the final material product. These aforementioned proportions do not significantly compromise the properties of the final Admixture Composite Materials. Examples of embodiments of the final Admixture Composite Materials are illustrated below. Although the embodiments of the formulated composites and carrier grout matrices can be comprehensively illustrated in different component combinations and permutations, along with their corresponding application to different aspects of radiation shielding management, only a summary of some specific, representative example illustrations are presented below and in the corresponding FIGS. 1, 2, 3, 4, 5 and 6. The respective numbers given in these figures represent the proportions (in weight percentages) of the multi-components used in a particular admixture composite material, and these numbers are assigned in parenthesis next to each component of an embodiment illustrated below. It should be understood that the radiation shielding admixture composites of the invention are necessarily limited thereto since alternative embodiments and applicability of embodiments will become apparent to those skilled in the art in view of the disclosure.

EXAMPLE EMBODIMENTS

1. Admixture Composite Material—A (see FIG. 1):

Leaded glass with 40% lead—30 weight percent—$LG40_{30}$ (10)

Boron oxide and hydroxide minerals: boracite ($Mg_{10}B_{14}O_{26}C_{12}$), hydroborocite ($CaMgB_6O_{11}5H_2O$), kernite ($Na_2B_4O_74H_2O$), priceite ($CaB_{10}O_{19}7H_2O$ sassolite ($H_3BO_3$), tincalconite ($Na_2B_4O_75H_2O$), tincal ($Na_2B_4O_710H_2O$)—10 weight percent—BO—$OH_{10}$ (13)

Aluminum hydroxide minerals: bauxite (hydrated aluminum and iron silicate), gibbsite [$Al(OH)_3$], diaspore [AlO(OH)], heulandite [(Na, Ca)$_2$Al$_{13}$(Al, Si)$_2$ Si$_{13}$O$_{36}$12H$_2$O ], clinoptilite [(Na, K, Ca)$_2$ Al$_{13}$ (Al,Si)$_2$ Si$_{13}$O$_{36}$12H$_2$O] and stilbite [Na$_3$Ca$_3$(Al$_8$ Si$_{28}$O$_{72}$)30 H$_2$O]—10 weight percent—AlO—$OH_{10}$ (12)

Lithium minerals: lepidolite mica [($K_2Li_3Al_4Si_7$(OH, F)$_3$)], spodumene ($LiAlSi_2O_6$), petalite ($LiAlSi_4O_{10}$), amblygonite [LiAl(F, OH)$PO_4$] and lithium hydrazinium sulfate [(Li ($N_2H_5SO_4$)]—10 weight percent—$LiM_{10}$ (11)

Type-A carrier grout matrix: 20 weight percent of I or II Portland cement, 5 weight percent Class N Pozzolan fly ash and 15 weight percent polyethylene fibers.—40 weight percent (14)

Alternatively, lead-bearing mineral material, in the same weight percentage, can easily be substituted for leaded glass. Similarly, Type-B—polymer modified asphaltenes and maltenes carrier grout matrix, Type-C—polymer modified polyurethane foam carrier grout matrix/admixture or combinations thereof, in the same overall weight percentage, can be substituted for Type-A carrier grout matrix. Other embodiments not specifically described herein will be apparent to one of ordinary skill in the art upon reviewing the above description.

2. Admixture Composite Material—B (see FIG. 2):

Leaded glass with 50% lead—20 weight percent—$LG50_{20}$ (22)

Boron oxide and hydroxide minerals: boracite ($Mg_{10}B_{14}O_{26}C_{12}$), hydroborocite ($CaMgB_6O_{11}5H_2O$), kernite ($Na_2B_4O_74H_2O$), priceite ($CaB_{10}O_{19}7H_2O$), sassolite ($H_3BO_3$), tincalconite ($Na_2B_4O_75H_2O$), and tincal ($Na_2$ $B_4O_710H_2O$)—15 weight percent—BO—$OH_{15}$ (23)

Aluminum hydroxide minerals: bauxite (hydrated aluminum and iron silicate), gibbsite [$Al(OH)_3$], diaspore [AlO(OH)], heulandite [(Na, Ca)$_2$ Al$_{13}$(Al, Si)$_2$Si$_{13}$O$_{36}$12H$_2$O ], clinoptilite [(Na, K, Ca)$_2$ Al$_{13}$(Al, Si)$_2$ Si$_{13}$O$_{36}$12H$_2$O] and stilbite [Na$_3$Ca$_3$(Al$_8$Si$_{28}$O$_{72}$) 30H$_2$O]—10 weight percent—AlO—$OH_{10}$ (20)

Coaliferous materials/compounds: bituminous and anthracite coals containing 90-95% carbon and 5-10% of variable amounts of associated minerals, such as quartz (SiO2), mullite (AlgSi$_2$ O$_{13}$), tricalcium aluminate (Ca$_3$Al$_2$ O$_6$), melilite [(Ca$_2$(Mg,Al)(AlSi)$_2$O$_7$)], merwinite [(Ca$_3$Mg(SiO$_4$)$_2$)], ferrite spinel [(Mg,Fe)(Fe.A1)$_2$)], pyrite ($FeS_2$), magnetite ($Fe_3O_4$), hematite ($Fe_2O_3$), lime (CaO), anhydrite ($CaSO_4$), periclase (MgO), and alkali sulfates [(Na,K)$_2$SO$_4$)]—10 weight percent—$CM_{10}$ (21)

Type-A carrier grout matrix: 30 weight percent of I or II Portland cement, 3 weight percent Class N Pozzolan fly ash and 12 weight percent polyethylene fibers—45 weight percent (24)

Alternatively, lead-bearing minerals, in the same weight percentage, can easily be substituted for leaded glass. Similarly, Type-B—polymer modified asphaltenes and maltenes carrier grout matrix, Type-C—polymer modified polyurethane foam carrier grout matrix or combinations thereof, in the same weight percentage, can easily be substituted for Type-A carrier grout matrix. Other embodiments not specifically described herein will be apparent to one of ordinary skill in the art upon reviewing the above description.

3. Admixture Composite Material—C (see FIG. 3):

Leaded glass with 40% lead—20 weight percent—$LG40_{20}$ (32)

Boron hydroxide minerals: hydroborocite ($CaMgB_6$ $O_{11}5H_2O$), kernite ($Na_2$ $B_4O_74H_2O$), priceite ($CaB_{10}O_{19}7H_2O$), tincalconite ($Na_2B_4O_7$ $5H_2O$) and tincal ($Na_2B_4O_710H_2O$)—20 weight percent—BO—$OH_{20}$ (30)

Lithium minerals: lepidolite mica [($K_2Li_3Al_4Si_7$(OH, F)$_3$)], spodumene ($LiAlSi_2O_6$), petalite ($LiAlSi_4O_{10}$) and amblygonite (LiAl(F, OH)$PO_4$)—10 weight percent—$LiM_{10}$ (31)

Type-A carrier grout matrix: 30 weight percent of I or II Portland cement, 3 weight percent Class N Pozzolan fly ash and 12 weight percent polyethylene fibers—30 weight percent and Type-B—polymer modified asphaltenes and maltenes carrier grout matrix—20 weight percent (33)

Alternatively, lead-bearing mineral material, in the same weight percentage, can easily be substituted for leaded glass. Similarly, Type-A carrier grout matrix, Type-C—carrier grout matrix alone or combinations thereof can easily be substituted, in the same weight percentage, for Type-B carrier grout matrix. Other embodiments not specifically described herein will be apparent to one of ordinary skill in the art upon reviewing the above description.

4. Admixture Composite Material—D (see FIG. 4):

Boron oxide, hydroxide and boride minerals: boracite ($Mg_{10}B_{14}O_{26}C_{12}$), hydroborocite ($CaMgB_6O_{11}5H_2O$), kernite ($Na_2B_4O_74H_2O$), priceite ($CaB_{10}O_{19}7H_2O$), tincalconite ($Na_2B_4O_75H_2O$), tincal ($Na_2$ $B_4O_710H_2O$) and silicon hexaboride ($SiB_6$)—30 weight percent—BO—$OH_{30}$ (40)

Iron hydroxide, silicate and carbonate minerals: hematite ($Fe_2O_3$), magnetite ($Fe_3O_4$), siderite ($FeCO_3$), goethite (Fe OOH), limonite [(Fe2O3), nH2O)], melanterite [$Fe^{2+}(SO_4).7(H_2O)$], lepidocrocite (Fe OOH), iron biotite mica [K(Mg, Fe) $3AlSi_3O_{10}$ $(OH)_2$] and ferrihydrite ($5Fe_2O_3O.9H_2O$)—15 weight percent—$FeM_{15}$ (41)

Titanium minerals: ilmenite ($FeTiO_3$), rutile ($TiO_2$) and titano-magnetite (TiO. $Fe_3O_4$)—5 weight percent—$TiM_5$ (42)

Lithium minerals: lepidolite mica [($K_2Li_3Al_4Si_7(OH, F)_3$)], spodumene ($LiAlSi_2O_6$), petalite ($LiAlSi_4O_{10}$), amblygonite ($LiAl(F, OH)PO_4$), lithium hydrazinium sulfate [(Li ($N_2H_5SO_4$)], and lithium hydride (LiH)—10 weight percent—$LiM_{10}$ (43)

Type-C—polymer modified polyurethane foam carrier grout matrix—40 weight percent (44)

Type-A carrier grout matrix, Type-B—polymer modified asphaltenes and maltenes carrier grout matrix or combinations thereof can easily be substituted, in the same 40 weight percentage, for Type-C carrier grout matrix. Other embodiments not specifically described herein will be apparent to one of ordinary skill in the art upon reviewing the above description.

5. Admixture Composite Material—E (see FIG. 5):

Lead-bearing minerals: cerussite [$PbCO_3.Pb(OH)$], linarite [$PbCu(SO_4)(OH)_2$], larsenite [$PbZnSiO_4OH$ (FeO, MgO, CaO)], lead-silicates (PbO2$SiO_2$), galena (PbS), anglesite ($PbSO_4$), wulfenite ($PbMoO_4$), leaded refractory ceramics, lead-chromates ($PbCrO_4$), tetraethyl lead [$Pb(C_2H_5)_4$ and lead acetate [$Pb(CH_3COO)_2$]—10 weight percent—$PbM_{10}$ (52)

Boron oxide, hydroxide and boride minerals: boracite ($Mg_{10}B_{14}O_{26}C_{12}$), hydroborocite ($CaMgB_6O_{11}5H_2O$), kernite ($Na_2B_4O_74H_2O$), priceite ($CaB_{10}O_{19}7H_2O$), sassolite ($H_3BO_3$), tincalconite ($Na_2B_4O_75H_2O$), tincal ($Na_2$ $B_4O_710H_2O$), Iron boride ($Fe_2B$) and silicon hexaboride ($SiB_6$)—15 weight percent—BO—$OH_{15}$ (51)

Aluminum hydroxide minerals: bauxite (hydrated aluminum and iron silicate), gibbsite [Al $(OH)_3$], heulandite [(Na, Ca)$_2$ $Al_{13}$(Al, Si)$_2$ $Si_{13}O_{36}$ $12H_2O$], stilbite [$Na_3Ca_3(Al_8Si_{28}O_{72})30$ $H_2O$] and and diaspore [AlO (OH)]—10 weight percent—AlO—$OH_{10}$ (50)

Lithium minerals: lepidolite mica [($K_2Li_3Al_4Si_7(OH, F)_3$)], spodumene ($LiAlSi_2O_6$), petalite ($LiAlSi_4O_{10}$), amblygonite ($LiAl(F, OH)PO_4$) and lithium hydride (LiH)—10 weight percent—$LiM_{10}$ (54)

Cadmium minerals: cadmium sulfide (greenockite and cadmium ocher), cadmium selenite (cadmoselite), cadmium fluroborate, cadmium carbonate and cadmium oxides—10 weight percent—$CdM_{10}$ (53)

Type-B—polymer modified asphaltenes and maltenes carrier grout matrix—45 weight percent (55)

Alternatively, Type-A carrier grout matrix, Type-C carrier grout matrix or their combinations thereof can easily be substituted in the same proportion (i.e. 45 weight percentage) for Type-B grout matrix. Other embodiments not specifically described herein will be apparent to one of ordinary skill in the art upon reviewing the above description.

6. Admixture Composite Material—F (see FIG. 6):

Boron oxide, hydroxide and boride minerals: boracite ($Mg_{10}B_{14}O_{26}C_{12}$), colemanite ($Ca_2B_6O_{11}5H_2O$), hydroborocite ($CaMgB_6O_{11}5H_2O$), kernite ($Na_2B_4O_74H_2O$), priceite ($CaB_{10}O_{19}$ $7H_2O$), sassolite ($H_3BO_3$), tincalconite ($Na_2B_4O_75H_2O$), tincal ($Na_2B_4O_710H_2O$), Iron boride ($Fe_2B$), silicon hexaboride ($SiB_6$), magnesium tetraboride ($MgB_4$), aluminum dodecaboride ($AlB_{12}$) and strontium hexaboride ($SrB_6$)—15 weight percent—BO—$OH_{15}$ (60)

Lead minerals: cerussite [$PbCO_3.Pb(OH)$], linarite [$PbCu(SO_4)$ $(OH)_2$], larsenite [$PbZnSiO_4OH$ (FeO, MgO, CaO)], lead-silicates (PbO $2SiO_2$), Galena (PbS), anglesite ($PbSO_4$), Wulfenite ($PbMoO_4$), leaded refractory ceramics and lead-chromates ($PbCrO_4$)—9 weight percent—$PbM_9$ (62)

Leaded glass with 40% lead—6 weight percent—$LG40_6$ (64)

Hydride material: ditantalum hydride ($Ta_2H$), lithium hydride (LiH) and titanium dihydride ($TiH_2$)—10 weight percent—$HydM_{10}$ (61)

Lithium minerals: lepidolite mica [($K_2Li_3Al_4Si_7$ $(OH, F)_3$)], spodumene ($LiAlSi_2O_6$), petalite ($LiAlSi_4O_{10}$), amblygonite ($LiAl(F, OH)PO_4$), lithium hydrazinium sulfate [(Li ($N_2H_5SO_4$)], and lithium hydride (LiH)—10 weight percent—$LiM_{10}$ (63)

Hydrated sulfate minerals: gypsum ($CaSO_4.0.5H_2O$), jarosite [$KFe^{3+}{}_3(SO_4)_2(OH)_6$], barite [$BaSO_4.0.5$ (H2O)], melanterite [Fe2+(SO4).7($H_2O$)], magnesium sulfate heptahydrate ($MgSO_4.7H_2O$), and other similar compounds—5 weight percent—$HSlf_5$ (65)

Type-C—polymer modified polyurethane foam carrier grout matrix—45 weight percent (66)

Alternatively, Type-B—carrier grout matrix, Type-A carrier grout matrix or combinations thereof can easily be used, in the same 45 weight percentage proportion, as an alternative to Type-C carrier grout matrix. Other embodiments not specifically described herein will be apparent to one of ordinary skill in the art upon reviewing the above description.

For demonstrating the efficacy of the invention materials for neutron-gamma radiation shielding, admixture composite material A, B and C were lab tested and compared with other prior art/conventional shielding admixture materials, which are concrete-based and denoted as "Hudson Admixture", "Mix #1 composite", Mix #2 composite" and "SNS admixture". In the admixture composite materials A and B, Type-A carrier grout matrix is used and in the admixture composite material C, Type-A and Type-B carrier grout matrices are used for testing. The test results have shown unexpected and unobvious capacities for shielding both neutron and gamma radiation. The test results are presented in Table 2 below, and illustrated in FIG. 8 and FIG. 9.

TABLE 2

Test results of radiation shielding capacities of Admixture Composite Material A, B and C of the invention as compared with the other admixtures (testing is based on MCNP4C model)

| Admixture Composites of the Invention | Neutron dose after exposure (mrem/hr) | Capture gamma dose after exposure (mrem/hr) |
|---|---|---|
| Admixture Composite Material - A | 26.2 | 0.3 |
| Admixture Composite Material - B | 23.5 | 0.3 |
| Admixture Composite Material - C | 2.8 | 0.2 |
| Other Admixtures | | |
| Hudson admixture | 85.0 | 3.3 |
| Mix #1 composite | 206.0 | 7.0 |
| Mix #2 composite | 207.0 | 6.6 |
| SNS admixture | 118.0 | 2.5 |

Input Parameters: Initial exposure dose of 100 micrograms Cf-252 source (about 800 mrem/hr). Cylindrical waste cask with inner length of 73 inches, inner diameter of 42 inches, wall thickness of 6 inches, bottom thickness of 6 inches and top thickness of 4 inches. Dose rates measured at the outer surface cylinder.

These test results show that the Admixture Composite Materials A, B and C provide up to 74 times more neutron radiation shielding capacity and up to 35 times more gamma radiation shielding capacity than the other admixture composite materials. Admixture Composite materials-C show significantly higher neutron radiation shielding than the admixture composites A and B. However, their capacity for shielding of gamma radiation is not significantly different.

It is obvious that the test results of the formulated multi-component admixture composites of the invention demonstrate unexpected and unobvious enhanced shielding of relatively high flux and energy neutron and gamma radiation. From these unexpected and unobvious results, it is apparent that these formulated shielding products of the invention when applied or used for management of deleterious radiation can provide unexpected benefits that are not otherwise obvious.

Figure 10:
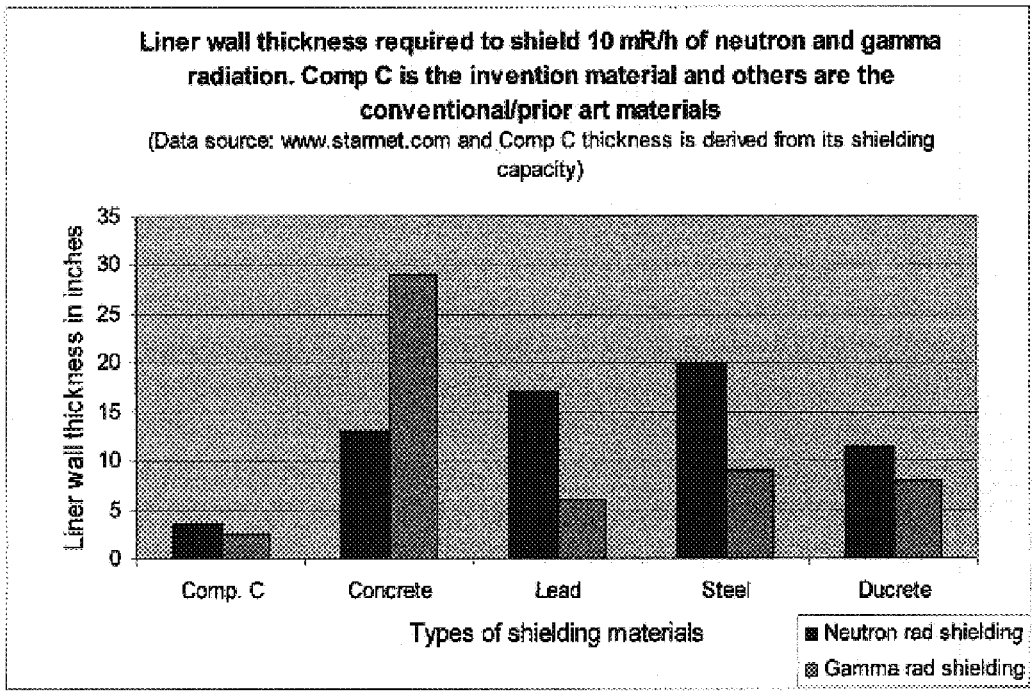
FIG. 10 is a plot of the shielding wall/liner thicknesses of Admixture Composite Material—C of this invention compared with other conventional or prior art admixture composites for shielding neutron and gamma radiation.

The multi-component admixture composites of this invention demonstrate a significant improvement over conventional shielding materials or the materials known in the art. These multi-component composites will provide a better radiation shielding technology than the conventional single or dual component technologies for enhancing the safety of handling, storage, transport, management and disposal of solid and liquid or mixed radioactive wastes. In addition, the multi-component based technology provides greater ease and flexibility of application for radiation shielding, and solidification and immobilization of liquid and sludge radioactive wastes than the conventional/prior art technology. Usage of admixture composite materials as inner packs or liners of waste containers can accommodate more container space for loading of additional waste by significantly reducing the thickness, dimensions and mass of radiation shielding inner packs or liners. The relative thickness of the shielding liner (container wall) made out of Admixture Composite Material—C of this invention was compared with the thicknesses of other conventionally used or prior art material liners for shielding of 10 mR/h energy flux of neutron and gamma radiation. The results are represented in histograms and presented in FIG. 10. The histograms show that for neutron radiation shielding, the thickness of Admixture Composite Material—C shielding liner/wall is roughly 4.5 times thinner than that of concrete, 6 times thinner than that of lead, 7 times thinner than that of steel and 4 times thinner than that of Ducrete. For gamma radiation shielding, the thickness of Admixture Composite Material—C shielding liner/wall is roughly 12 times thinner than that of concrete, 2.5 times thinner than that of lead, 3.6 times thinner than that of steel and 3 times thinner than that of Ducrete. These demonstrate that the liner made out of formulated Admixture Composite Material—C of this invention is better than those made out of conventional or prior art shielding materials by providing technological superiority, and environmental and economic benefits. Technologically, the composite material of this invention has superior radiation shielding capacity (see FIG. 8 and FIG. 9), and as a result only a thinner liner is required for shielding the given flux of radiation. Usage of thinner liner made out relatively low density composite material will accommodate loading of additional waste in the same container. Consequently, usage of the composite material of this invention with superior radiation shielding capacity renders safe handling and storage, ease of handling and retrieval, transportation, management and disposal of containerized radioactive wastes of variable radiation fluxes and energies, as well as economic benefits.

Examples of Applicability of Embodiments of Admixture Composite Materials

There are a wide variety of applications of radiation-shielding admixture composites of the present invention to various aspects of high-level, transuranic and low-level radioactive waste management, as well as to management of decontamination of radioactively contaminated facilities and equipment, and uranium-thorium mill and mine tailings. Depending on the type of application and the conditions, various multi-component mixtures (composites) of minerals and materials are preferred for formulating the composites. Admixture composite materials are formulated using the specific mineral composites and mixing them in various proportions with selected carrier grout matrix of this invention. For various radiation shielding applications (see 706 in FIG. 7), slurries, solids, liquids or viscous material of admixture composite materials are produced (see 705 in FIG. 7). Table 3 lists the formulated admixture composite materials, their physical form and relative densities required for a given type of application, as well as the corresponding application methods.

TABLE 3

| Type of Application | Admixture composite material | Physical form | Relative Density | Application method |
|---|---|---|---|---|
| Over and inner packs or liners for storage and transport casks and containers as an alternative to lead and concrete shielding or for partial substitution | Admixture composite material: A, B or C | Slurry, viscous materials or solids | Lighter than conventional concrete and lead or Ducrete liners | Pouring or injection, pre-fabrication of structures or molds |
| Coatings for corrosion and radiation protection of waste containers and packages, drip shields | Admixture composite material: D, E or F | Liquids or viscous materials | Lighter than conventional concrete | Spraying |

TABLE 3-continued

| Type of Application | Admixture composite material | Physical form | Relative Density | Application method |
|---|---|---|---|---|
| Vaults for storage of nuclear wastes, materials and war-heads, and structures for linear accelerator facilities | Admixture composite material: D, E or F | Slurry or solid | Lighter than conventional concrete | Prefabrication of structures |
| Impact limiting structures and padding liners for waste transport containers/casks | Admixture composite material: D, E or F | Viscous materials | Lighter than conventional concrete | Prefabrication of structures and padding liners |
| Encapsulation of spent fuel, radioactive wastes, tank wastes and contaminated soils | Admixture composite material: A, B, C or combinations | Viscous materials or liquids | Lighter than conventional concrete and Ducrete | Spraying |
| Liquid/sludge waste solidification and immobilization | Admixture composite material: C, D, E, F or combinations | Solids | Lighter than conventional concrete | Pouring, mixing and spraying |
| Shielding radioactive Beryllium blocks | Admixture composite material: C, D, E, F or combinations | Viscous materials | Lighter than conventional concrete | Spraying |
| Coating of thermal neutron facilities and equipment | Admixture composite material: A, B or C | Liquids and viscous materials | Lighter than conventional concrete | Spraying |
| Radioactive decontamination of facilities and equipment for decommissioning | Admixture composite material: D, E, F or combinations | Viscous materials | Lighter than conventional concrete | Spraying |
| Radioactive dust suppressant application | Admixture composite material: D, E or F | Liquids and viscous materials | Lighter than conventional concrete | Spraying |
| Structures for x-ray rooms | Admixture composite material: A, D, E or F | Slurry or solids | Lighter than conventional concrete | Prefabrication of structures |
| Impeding diffusion of gases-radon or iodine | Admixture composite material: C, B or E | Viscous materials or solids | Lighter than concrete | Prefabrication of structures/liners |

Although specific embodiments of the formulated admixture composite materials of the invention are illustrated and described herein, this disclosure is intended to cover any and all combinations and permutations of various embodiments of the invention. Furthermore, it is to be understood that the description of the embodiments given above has been made in an illustrative fashion, and not a restrictive one. Combination of the illustrated composite embodiments, and other embodiments not specifically described herein will be apparent to one of ordinary skill in the art upon reviewing the above-mentioned descriptions and illustrations. The scope of variations in the embodiments of this invention includes any other applications in which the materials and techniques of this invention, as well as their permutations and combinations, can be used. Therefore, the scope of various embodiments and their application of this invention should be determined with reference to the appended claims, along with the full range of equivalents to which such claims are entitled.

The invention claimed is:

1. A radiation shielding admixture composite material comprising:

a) a composite of both gamma and neutron radiation shielding naturally occurring mineral materials, selected from the group consisting of:

i) Lead mineral materials, wherein the lead mineral materials are at least one of linarite [$PbCu(SO_4)(OH)_2$], larsenite [$PbZnSiO_4OH$ (FeO, MgO, CaO)], lead- silicates ($PbO2SiO_2$), galena (PbS), anglesite ($PbSO_4$), wulfenite ($PbMoO_4$) and lead-chromate (crocite-$PbCrO_4$) in amounts ranging from 10-50 weight percent of said radiation shielding admixture composite;

ii) Boron mineral materials, wherein the boron mineral materials are at least one of hydroborocite ($CaMgB_6O_{11}5H_2O$), boracite ($Mg_{10}B_{14}O_{26}C_{12}$), sassolite ($H_3BO_3$), tincalconite ($Na_2B_4O_75H_2$), Iron boride ($Fe_2B$), silicon hexaboride ($SiB_6$), aluminum dodecaboride ($AlB_{12}$), magnesium tertaboride ($MgB_4$) and strontium hexaboride ($SrB_6$) in amounts ranging from 10-50 weight percent of said radiation shielding admixture composite;

iii) Cadmium mineral materials; wherein the cadmium mineral materials are at least one of greenockite (CdS), cadmium ocher [CdS, $FeO(OH)_n$], cadmoselite (CdSe), cadmium fiuroborate [CdO, K, F ($BO_4$)]cadmium carbonate (otavite-$CdCO_3$) and cadmium oxides in amounts ranging from 2-20 weight percent of said radiation shielding admixture composite;

iv) Iron mineral materials, wherein the iron mineral materials are at least one of siderite ($FeCO_3$), goethite (FeOOH), melanterite [$Fe^{2+}(SO_4).7(H_2O)$], lepidocrocite (Fe OOH), iron biotite mica [$K(Mg, Fe)3AlSi_3O_{10}(OH)_2$]and ferrihydrite ($5Fe_2O_3.9H_2O$) in amounts ranging from 5-30 weight percent of said radiation shielding admixture composite;

v) Lithium mineral materials, wherein the lithium mineral materials are at least one of lepidolite mica [$(K_2Li_3Al_4Si_7(OH, F)_3)$], spodumene ($LiAlSi_2O_6$), petalite ($LiAlSi_4O_{10}$), amblygonite ($LiAl(F, OH)PO_4$), lithium hydrozinium sulfate [$Li(N_2H_5SO_4)$]and lithium hydride (LiH) in amounts ranging from 5-30 weight percent of said radiation shielding admixture composite;

vi) Aluminum mineral materials, wherein the aluminum mineral materials are at least one of gibbsite [$Al(OH)_3$], heulandite [$(Na, Ca)_2Al_{13}(Al, Si)_2Si_{13}O_{36}12H_2O$], clinoptilite [$(Na, K, Ca)_2Al_{13}(Al,Si)_2Si_{13}O_{36}12H_2O$], stilbite[$Na_3Ca_3(Al_8\ Si_{28}O_{72})30H_2O$] and diaspore [AlO(OH)]in amounts ranging from 5-25 weight percent of said radiation shielding admixture composite;

vii) Coal mineral materials, wherein the coal mineral materials are at least one of sub-bituminous to bituminous coal with 90 percent carbon and 10 percent other mineral materials, anthracite coal with 90-95 percent carbon and 5-10 percent other associated mineral materials in amounts ranging from 3-20 weight percent of said radiation shielding admixture composite;

viii) Titanium mineral materials, wherein the titanium mineral materials are at least one of rutile ($TiO_2$) and titano-magnetite ($TiO.Fe_3O_4$) in amounts ranging from 5-25 weight percent of said radiation shielding admixture composite;

ix) Sulfate mineral materials, wherein the sulfate mineral materials are at least one of jarosite [$KFe^{3+}{}_3(SO_4)_2(OH)_6$], melanterite [Fe2(SO4).7(H2O)]and magnesium sulfate heptahydrate ($MgSO_4 .7H_2O$) in amounts ranging from 2-15 weight percent of said radiation shielding admixture composite;

x) Hydride mineral materials, wherein the hydride mineral materials are at least one of ditantalum hydride ($Ta_2H$), lithium hydride (LiH) and titanium dihydride ($TiH_2$) in amounts ranging from 5-15 weight percent of said radiation shielding admixture composite;

xi) Leaded-glass material, wherein the leaded-glass material is at least one of 20 percent lead glass, 30 percent lead glass, 40 percent lead glass, 50 percent lead glass in amounts ranging from 5-50 weight percent of said radiation shielding admixture composite; or xii) Combinations of i-xi b) Carrier grout matrix selected from the group consisting of:

i) Type A—Modified cement carrier grout matrix; wherein the Type A carrier grout matrix comprising:

a) 20-40 weight percent of Type I Portland cement, 10-15 weight percent of cement-kiln dust, 5-20 weight percent of polyethylene fibers, 5-15 weight percent of steel fibers, 5-10 weight percent of polymeric graphite and 5-10 weight percent of ground blast furnace slag in amounts ranging from 20-50 weight percent of said radiation shielding admixture composite;

b) 20-40 weight percent of Type II Portland cement, 5-20 weight percent of polyethylene fibers, 5-15 weight percent of steel fibers, 5-10 weight percent of polymeric graphite, 2-10 weight percent of Class-N Pozzolan fly ash, 5-15 weight percent of cement-kiln dust and 5 weight percent of ground blast furnace slag in amounts ranging from 20-50 weight percent of said radiation shielding admixture composite;

c) 20-40 weight percent of cements modified with hydrated calcium-alumina silicate, iron, alumina-hydrated calcium sulfate and magnesium oxychloride-phosphate, 5-15 weight percent of Plaster of Paris, 5-10 weight percent of silica-gel and 10 weight percent of clays in amounts ranging from 20-50 weight percent of said radiation shielding admixture composite; or d) Combinations of a, b and c ii) Type B—Polymer modified asphaltenes and maltenes carrier grout matrix; wherein the Type B carrier grout matrix comprising of:

a) Asphaltenes and maltenes modified with elastomers, polymers, emulsifiers, dispersants, gallants, antioxidant stabilizers, aromatic solvents, plasticizers, fire retardants, and curing and cross-linking agents in amounts ranging from 20-50 weight percent of said radiation shielding admixture composite;

b) Asphaltenes and maltenes modified with thermoplastic elastomers, polymers, thermosetting modifiers, chemical modifiers, fibers, adhesion improvers, natural asphalts and fillers in amounts ranging from 20-50 weight percent of said radiation shielding admixture composite; or c) Combination of a and b iii) Type C—Polymer modified polyurethane foam carrier grout matrix, wherein the Type C carrier grout matrix comprising of:

a) Polyurethane foam modified by a composite of isocynates (diphenylmethane 4, 4'diisocyanate) and aromatic isocyanurate (toluene 2, 4 and 2, 6 diisocyanates), modified with triols, tetrols, amines, metal salts, organometallic compounds and silicones in amounts ranging from 20-50 weight percent of said radiation shielding admixture composite;

b) Polyurethane foam modified by a composite of isocynates, polyols and isocynates (diphenylmethane 4, 4'diisocyanate), modified with triols, tetrols, amines, metal salts and oraganometallic compounds and silicones in amounts ranging from 20-50 weight percent of said radiation shielding admixture composite;

c) Polyurethane foam modified by a composite of polymer/resin and ethylene bis-tetrabromophthalimide modified with chlorinated phosphonate ester, neutral phosphorus-based polyol, hexabromocylododecane, tetrabromocuclooctane, hexabromododecane and bisphenol-A type epoxy in amounts ranging from a 20-50 weight percent of said radiation shielding admixture composite; or d) Combinations of a, b and c;

and iv) Combinations of i, ii and iii.

2. The radiation shielding admixture composite material of claim 1, wherein the admixture composite material comprises:

30 weight percent of leaded-glass with 40% lead;

10 weight percent of boron mineral material comprising boracite ($Mg_{10}B_{14}O_{26}O_{12}$), hydroborocite ($CaMgB_6O_{11}5H_2O$), sassolite ($H_3BO_3$), tincalconite ($Na_2B_4O_75H_2O$), iron boride ($Fe_2B$) and silicon hexaboride ($Si\ B_6$);

10 weight percent of aluminum mineral material comprising gibbsite [$Al(OH)_3$], heulandite [$(Na, Ca)_2Al_{13}(Al, Si)_2Si_{13}O_{36}12H_2O$], clinoptilite [$(Na, K, Ca)_2Al_{13}(Al,Si)_2Si_{13}O_{36}12H_2O$] and stilbite [$Na_3Ca_3(Al_8Si_{28}O_{72})\ 30H_2O$] and diaspore [AlO(OH)];

10 weight percent of lithium mineral material comprising lepidolite mica [$(K_2Li_3Al_4Si_7(OH, F)_3)$], spodumene ($LiAlSi_2O_6$), petalite ($LiAlSi_4O_{10}$), and amblygonite [$LiAl(F,OH)PO_4$]; and 40 weight percent of Type-A carrier grout matrix comprising 40 weight percent of Type I or Type II Portland cement 10 weight percent Class N Pozzolan fly ash, 15 weight percent steel fibers and 20 weight percent polyethylene fibers, 10 weight percent cement- kiln dust and 5 weight percent of blast furnace slag.

3. The radiation shielding admixture composite material of claim 1 wherein the admixture composite material comprises:

30 weight percent of boron mineral material comprising boracite ($Mg_{10}B_{14}O_{26}C_{12}$), hydroborocite ($CaMgB_6O_{11}5H_2O$), tincalconite ($Na_2B_4O_75H_2O$), and silicon hexaboride ($SiB_6$);

15 weight percent of iron-bearing mineral material comprising siderite ($FeCO_3$), goethite (Fe OOH), melanterite [$Fe^{2+}(SO^4)7(H_2)$], lepidocrocite (Fe OCH), iron biotite mica [$K(Mg, Fe)\ 3AlSi_3O_{10}(OH)_2$] and ferrihydrite ($5Fe_2O_3.9H_2O$);

5 weight percent of titanium mineral material comprising rutile ($TiO_2$) and titano-magnetite ($TiO\ Fe_3O_4$);

10 weight percent lithium mineral material comprising lepidolite mica [$(K_2Li_3Al_4Si_7(OH, F)_3)$], spodumene ($LiAlSi_2O_6$), petalite ($LiAlSi_4O_{10}$), amblygonite ($LiAl(F, OH)PO_4$) and Lithium hydride (LiH); and 40 weight percent of Type-C—polymer modified polyurethane foam carrier grout matrix wherein the modification is with a composite of polymer/resin and ethylene bis-tetrabromophthalimide modified with chionnated phosphonate ester, neutral phosphorus-based polyol, hexabromocyclododecane, tetrabromocuclooctane, hexabromododecane and bisphenol-A type epoxy.

4. The radiation shielding admixture composite material of claim 1, wherein the admixture composite material comprises:

10 weight percent lead-bearing mineral material comprising linarite [$PbCu(SO_4)(OH)_2$], larsenite [$PbZnSiO_4OH(FeO, MgO, CaO)$], lead-silicates ($PbO\ 2SiO_2$), wulfenite ($PbMoO_4$) and lead-chromates ($PbCrO_4$);

15 weight percent of boron mineral material comprising boracite ($Mg_{10}B_{14}O_{26}C_{12}$), hydroborocite ($CaMgB_6O_{11}5H_2O$), sassolite ($H_3BO_3$), tincalconite ($Na_2B_4O_75H_2O$), Iron boride ($Fe_2B$) and silicon hexaboride ($SiB_6$);

10 weight percent of aluminum mineral material comprising, gibbsite [$Al(OH)_3$], heulandite [$(Na, Ca)_2\ Al_{13}(Al, Si)_2Si_{13}O_{36}12H_2O$], stilbite [$(Na_3Ca_3(Al_8Si_{28}O_{72})\ 30H_2O$], clinoptilite [$(Na, K, Ca)_2Al_{13}(Al, Si)_2Si_{13}O_{36}12H_2O$] and diaspore [$AlO(OH)$];

10 weight percent of lithium mineral material comprising lepidolite mica [$(K_2Li_3Al_4Si_7(OH, F)_3)$], spodumene ($LiAlSi_2O_6$), petalite ($LiAlSi_4O_{10}$), amblygonite ($LiAl(F, OH)PO_4$) and lithium hydride (LiH);

10 weight percent of cadmium mineral material comprising cadmium sulfide-(greenockite and cadmium ocher), cadmium selenite (cadmoselite), cadmium fluroborate, cadmium carbonate, and cadmium oxides; and 45 weight percent of Type-B—polymer modified asphaltenes and maltenes carrier grout matrix wherein the modification is with elastomers, polymers, emulsifiers, dispersants, gallants, antioxidant stabilizers, aromatic solvents, plasticizers, fire retardants, and curing and cross-linking agents.

5. The radiation shielding admixture composite material of claim 1, wherein the admixture composite material comprises:

20 weight percent of boron mineral material comprising boracite ($Mg_{10}B_{14}O_{26}C_{12}$), sassolite ($H_3BO_3$), hydroborocite ($CaMgB_6O_{11}5H_2O$), tincalconite ($Na_2B_4O_75H_2O$), iron boride ($Fe_2B$), silicon hexaboride ($SiB_6$), magnesium tertaboride ($MgB_4$), aluminum dodecaboride ($AlB_{12}$) and strontium hexaboride ($SrB_6$), 14 weight percent of lead mineral material comprising, linarite [$PbCu(SO_4(OH)_2$], larsenite [$PbZnSiO_4OH(FeO, MgO, CaO)$], lead-silicates ($PbO\ 2SiO_2$), wulfenite ($PbMoO_4$) and lead-chromates ($PbCrO_4$), 6 weight percent of leaded-glass material with 40% lead, 10 weight percent of lithium mineral material comprising Lepidolite mica [$(K_2Li_3Al_4Si_7(OH, F)_3)$], spodumene ($LiAlSi_2O_6$), petalite ($LiAlSi_4O_{10}$), amblygonite ($LiAl(F\ OH)PO_4$), lithium hydrazinium sulfate [$(Li(N_2H_5SO_4$], and Lithium hydride (LiH), 5 weight percent of hydrated sulfate mineral material comprising jarosite [$KFe^{3+}{}_3(SO_4(OH)_6$], barite [$BaSO_40.5(H_2O)$], melanterite [Fe2+(SO4).7(H2O)], and magnesium sulfate heptahydrate ($MgSO_4.7H_2O$); and 45 weight percent of Type-C—polymer modified polyurethane foam carrier grout matrix wherein the modification is with a composite of isocynates (diphenylmethane 4, 4'diisocyanate) and aromatic isocyanurate (toluene 2, 4 and 2, 6 dilsocyanates), modified with triols, tetrols, amines, metal salts, orpanometallic compounds and silicones.

6. The radiation shielding admixture composite material of claim 1, wherein the radiation shielding admixture composite material comprises:

10 weight percent of lead mineral material comprising linarite [$PbCu(SO_4)\ (OH)_2$], larsenite [$PbZnSiO_4OH(FeO, MgO, CaO)$], lead-silicates ($PbO2SiO_2$), wulfenite ($PbMoO_4$) and lead-chromates ($PbCrO_4$);

6 weight percent of leaded-glass material with 40% lead;

15 weight percent of boron mineral material comprising hydroborocite ($CaMgB_6O_{11}5H_2O$), boracite ($Mg_{10}B_{14}O_{26}C_{12}$), sassolite ($H3BO_3$), tincalconite ($Na_2B_4O_75H_2O$), iron boride ($Fe_2B$), silicon hexaboride ($SiB_6$), magnesium tertaboride ($MgB_4$), aluminum dodecaboride ($AlB_{12}$) and strontium hexaboride ($SrB_6$);

9 weight percent of hydride mineral material comprising ditantalum hydride ($Ta_2H$), lithium hydride (LiH), titanium dihydride ($TiH_2$);

10 weight percent of lithium mineral material comprising lepidolite mica [$(K_2Li_3Al_4Si_7(OH, F)_3)$], spodumene ($LiAlSi_2O_6$), petalite ($LiAlSi_4O_{10}$), lithium hydride (LiH) and amblygonite ($LiAl(F, OH)P_4$);

5 weight percent of hydrated sulfate mineral material comprising jarosite [$KFe^{3+}{}_3(SO_4)_2(OH)_6$], melanterite (Fe2(SO4).7(H2O)], magnesium sulfate heptahydrate ($MgSO_4.7(H_2O)$; and 45 weight percent of Type-C—Polymer modified polyurethane foam carrier grout matrix wherein the modification is with a composite of polymer/resin and ethylene bis-tetrabromophthalimide modified with chlorinated phosphonate ester, neutral phosphorus-based polyol, hexabromocyclododecane, tetrabromocuclooctane, hexabromododecane and bisphenol-A type epoxy.

7. A radiation shielding admixture composite material comprising:

20 weight percent of leaded-glass with 40% lead;

20 weight percent of boron mineral material comprising hydroborocite ($CaMgB_6O_{11}5H_2O$), boracite ($Mg_{10}B_{14}O_{26}C_{12}$), tincalconite ($Na_2B_4O_75H_2O$) and silicon hexaboride ($SiB_6$);

10 weight percent lithium mineral materials comprising lepidolite mica [$(K_2Li_3Al_4Si_7(OH, F)_3)$], spodumene ($LiAlSi_2O_6$), petalite ($LiAlSi_4O_{10}$) and amblygonite ($LiAl(F, OH)PO_4$);

30 weight percent of Type-A carrier grout matrix comprising 80 weight percent of Type I or Type II Portland cement, 8 weight percent Class-N Pozzolan fly ash and 12 weight percent polyethylene fibers; and 20 weight percent of Type-B—polymer modified asphaltenes and maltenes carrier grout matrix, wherein the modification is with thermoplastic elastomers, polymers, thermosetting modifiers, chemical modifiers, fibers, adhesion improvers, natural asphalts and fillers.

8. A radiation shielding admixture composite material comprising:

20 weight percent of leaded-glass with 50% lead;

15 weight percent of boron mineral material comprising boracite ($Mg_{10}B_{14}O_{26}C_{12}$), hydroborocite ($CaMgB_6O_{11}5H_2O$), sassolite ($H_3BO_3$) and tincalconite ($Na_2B_4O_75H_2O$);

10 weight percent of aluminum mineral material comprising gibbsite [$Al(OH)_3$], heulandite [$(Na, Ca)_2Al_{13}(Al,Si)_2Si_{13}O_{36}12H_2O$], clinoptilite [$(Na, K, Ca)_2Al_{13}(Al,Si)_2Si_{13}O_{36}12H_2O$], stilbite [$Na_3Ca_3(Al_8Si_{28}O_{72})30H_2O$] and diaspore [AlO(OH)];

10 weight percent of coaliferous mineral material comprising bituminous and anthracite coals containing 90-95% carbon and 5-10% of variable amounts of associated quartz (SiO2), mullite ($AlgSi_20_{13}$), tricalcium aluminate ($Ca_3Al_20_6$), melilite [$(Ca_2(Mg, Al)(Al Si)_20_7)$], merwinite [$(Ca_3Mg(Si0_4)_2)$], ferrite spinel [$(Mg, Fe)(Fe.A1)_2)$], pyrite ($FeS_2$), magnetite ($Fe_30_4$), hematite ($Fe_20_3$), lime (CaO), anhydrite ($CaS0_4$), penclase (MgO), and alkali sulfates [$(Na,K)_2S0_4)$]; and 45 weight percent of Type-A carrier grout matrix comprising 80 weight percent of Type I or Type II Portland cement 8 weight percent Class N Pozzolan fly ash and 12 weight percent polyethylene fibers.

* * * * *